US010527335B2

(12) United States Patent
Bertolini et al.

(10) Patent No.: US 10,527,335 B2
(45) Date of Patent: Jan. 7, 2020

(54) SLIMLINE ICE COMPARTMENT HAVING SIDE-BY-SIDE ICE MAKER AND ICE BUCKET

(71) Applicants: BSH Home Appliances Corporation, Irvine, CA (US); BSH Hausgeräte GmbH, Munich (DE)

(72) Inventors: Nilton Bertolini, Knoxville, TX (US); Cetin Abdullah Celik, Cerkezköy (TR); Jorge Carlos Montalvo Sanchez, Knoxville, TN (US); Vishal Vekariya, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 150 days.

(21) Appl. No.: 15/643,595

(22) Filed: Jul. 7, 2017

(65) Prior Publication Data

US 2019/0011161 A1 Jan. 10, 2019

(51) Int. Cl.

| | |
|---|---|
| ***F25C 1/04*** | (2018.01) |
| ***F25C 5/20*** | (2018.01) |
| ***F25C 5/185*** | (2018.01) |

(52) U.S. Cl.

CPC ..... *F25C 1/04* (2013.01); *F25C 5/185* (2013.01); *F25C 5/22* (2018.01); *F25C 5/24* (2018.01); *F25D 2317/061* (2013.01)

(58) Field of Classification Search

CPC ..... F25C 1/24; F25C 5/22; F25C 2400/10
See application file for complete search history.

(56) References Cited

U.S. PATENT DOCUMENTS

| | | | | |
|---|---|---|---|---|
| 1,380,533 | A * | 6/1921 | Curran | F25D 23/066 217/128 |
| 3,648,462 | A * | 3/1972 | Lyman | F25C 1/147 165/135 |
| 7,406,838 | B2 * | 8/2008 | Wang | F25C 1/08 62/344 |
| 8,479,533 | B2 | 7/2013 | Chase et al. | |
| 8,511,106 | B2 * | 8/2013 | Ducharme | F25C 5/22 62/344 |
| 8,973,391 | B2 * | 3/2015 | Lee | F25C 5/046 62/340 |
| 9,080,799 | B2 * | 7/2015 | Hong | F25C 1/00 |
| 9,188,377 | B2 | 11/2015 | Choi et al. | |
| 9,234,690 | B2 | 1/2016 | McCollough et al. | |
| 2006/0266059 | A1 | 11/2006 | Wetekamp et al. | |

(Continued)

FOREIGN PATENT DOCUMENTS

EP 2650628 A2 * 10/2013 ..... F25D 23/064

OTHER PUBLICATIONS

National Search Report EP 18 17 7761 dated Nov. 12, 2018.

*Primary Examiner* — Filip Zec
(74) *Attorney, Agent, or Firm* — Michael E. Tschupp; Andre Pallapies; Brandon G. Braun

(57) ABSTRACT

A refrigerator including a fresh food compartment; a freezer compartment; an ice compartment disposed in at least one of the fresh food compartment or the freezer compartment; an ice maker disposed in the ice compartment; and an ice bucket for storing ice, the ice bucket being disposed in the ice compartment. The ice maker and the ice bucket are arranged side-by-side in a horizontal direction within the ice compartment.

32 Claims, 19 Drawing Sheets

(56) References Cited

U.S. PATENT DOCUMENTS

| | | | | |
|---|---|---|---|---|
| 2010/0257889 | A1* | 10/2010 | Lee | F25C 1/24 62/344 |
| 2011/0167862 | A1 | 7/2011 | Shin et al. | |
| 2013/0298404 | A1 | 11/2013 | An et al. | |
| 2014/0182325 | A1* | 7/2014 | Lee | F25C 1/04 62/351 |
| 2016/0370055 | A1* | 12/2016 | Yang | B23P 15/26 |

* cited by examiner

SLIMLINE ICE COMPARTMENT HAVING SIDE-BY-SIDE ICE MAKER AND ICE BUCKET

FIELD OF THE INVENTION

The present disclosure relates generally to a refrigerator appliance and to an ice compartment for housing an ice maker and an ice bucket for storing ice. More particularly, the present disclosure relates to a slimline ice compartment having a side-by-side ice maker and ice bucket.

BACKGROUND OF THE INVENTION

In general, refrigerator appliances, such as for household use, typically have a bulky ice compartment for making and storing ice located within the fresh food compartment. The ice compartment assembly has an over-under arrangement where the ice maker is positioned on top and the ice bucket is located underneath the ice maker within the ice compartment.

SUMMARY OF THE INVENTION

On the other hand, making the ice compartment and bucket larger especially in the vertical height direction takes up too much volume in the fresh food compartment, thereby making it less desirable to customers/users. In this regard, customers/users want to maximize the volume of the fresh food compartment for the storage of fresh food items. Making the ice compartment taller also limits a design to be used only on taller doors (for example, it would not be useable in models with more than 1 drawer and two doors), and/or require the ice and water dispenser to be positioned at a lower position which is not ergonomically optimum for customers/users.

An apparatus consistent with the present disclosure is directed to a self-contained, dedicated compartment for producing and storing ice, without using cold air that is produced outside of the ice compartment and then ducted to and from the ice compartment.

An apparatus consistent with the present disclosure is directed to a slimline ice compartment having a side-by-side ice maker and ice bucket.

An apparatus consistent with the present disclosure is directed to a slimline ice compartment which takes up less volume in the fresh food compartment and results in faster ice production.

An apparatus consistent with the present disclosure is directed to various shapes of the slimline ice compartment.

An apparatus consistent with the present disclosure is directed to a front cover of the ice bucket and an open gasket disposed between the front cover and the slimline ice compartment.

According to one aspect, the present disclosure provides a refrigerator including a fresh food compartment; a freezer compartment; an ice compartment disposed in at least one of the fresh food compartment or the freezer compartment; an ice maker disposed in the ice compartment; and an ice bucket for storing ice, the ice bucket being disposed in the ice compartment. The ice maker and the ice bucket are arranged side-by-side in a horizontal direction within the ice compartment.

According to another aspect, the ice compartment is disposed in the fresh food compartment.

According to another aspect, the ice compartment is disposed in an upper corner of the fresh food compartment.

According to another aspect, the refrigerator is a French door-bottom mount configuration having the fresh food compartment on top and the freezer compartment below the fresh food compartment.

According to another aspect, the ice compartment is disposed in an upper left hand corner of the fresh food compartment.

According to another aspect, the ice bucket is removably mounted in the ice compartment.

According to another aspect, the ice compartment has a thin dimension in a vertical height direction H of approximately 5.6 inches±2.0 inches.

According to another aspect, the ice compartment has a horizontal width W of approximately 10.4 inches±2.0 inches.

According to another aspect, the ice bucket has a front cover, and the front cover has an opening in a bottom portion for discharging pieces of ice.

According to another aspect, the fresh food compartment includes a door, and further comprising an ice chute for an ice dispenser and being disposed in the door, the ice chute being configured to communicate with the opening in the front cover via an ice chute extension.

According to another aspect, the front cover has an open gasket with a labyrinth disposed between the front cover and the ice compartment.

According to another aspect, the ice bucket includes a plurality of ribs on a bottom surface thereof.

According to another aspect, the ice compartment is formed by a U-shaped, insulated housing that cooperates with an inner top wall and an inner back wall of the fresh food compartment.

According to another aspect, a gasket is disposed between an edge of the U-shaped, insulated housing and the inner top wall and the inner back wall of the fresh food compartment.

According to another aspect, a housing collar is disposed on an open front portion of the U-shaped, insulated housing, the housing collar having an opening therein for receiving the ice bucket.

According to another aspect, the housing collar includes at least one retention rib that projects into the opening and is configured to engage with the ice bucket to retain the ice bucket within the ice compartment on condition that the ice bucket is fully inserted into the ice compartment.

According to another aspect, the U-shaped, insulated housing includes locating extensions extending from a lower rear portion of the edge, the locating extensions being configured to fit into a bracket positioned in the inner back wall of the fresh food compartment.

According to another aspect, a housing collar is disposed on an open front portion of the U-shaped, insulated housing, the housing collar having an opening therein for receiving the ice bucket, and further having a plurality of fastener holes configured to receive fasteners for fastening the U-shaped, insulated housing to the inner top wall of the fresh food compartment.

According to another aspect, the ice compartment is formed by an L-shaped, insulated housing that cooperates with an inner side wall, an inner top wall, and an inner back wall of the fresh food compartment.

According to another aspect, a gasket is disposed between an edge of the L-shaped insulated housing and the inner top wall, the inner side wall, and the inner back wall of the fresh food compartment.

According to another aspect, the L-shaped, insulated housing includes a vertical projection on an end of a horizontal portion of the L-shape, the vertical projection being configured to engage with a stepped portion of the inner side wall of the fresh food compartment.

According to another aspect, a gasket is disposed between an edge of the L-shaped insulated housing and the inner top wall, the stepped portion of inner side wall, and the inner back wall of the fresh food compartment.

According to another aspect, the ice bucket includes an anti-rotation member disposed on a rear exterior wall thereof and which is configured to engage with a complementary member disposed at a rear portion of the ice compartment.

According to another aspect, the anti-rotation member comprises an annular rim projecting from the rear exterior wall of the ice bucket and having a pair of recesses configured to engage with corresponding H-shaped projections as the complementary member formed on an air handler/auger motor assembly.

According to another aspect, no portion of the ice bucket is located below the ice maker when the ice maker is projected downward in a vertical height direction.

According to another aspect, a housing collar is disposed on an open front portion of the ice compartment, the housing collar having an opening therein for receiving the ice bucket, and wherein the housing collar includes at least one retention rib that projects into the opening and is configured to engage with front end portions of the plurality of ribs on the bottom surface of the ice bucket to retain the ice bucket within the ice compartment on condition that the ice bucket is fully inserted into the ice compartment.

According to another aspect, the front cover has an open gasket with a generally U-shape having an open portion facing one of up, down, left, or right disposed between the front cover and the ice compartment.

According to another aspect, the present disclosure provides a refrigerator comprising a refrigerator compartment; a freezer compartment; an ice compartment disposed in the refrigerator compartment; an ice maker disposed in the ice compartment; and an ice bucket for storing ice, the ice bucket being disposed in the ice compartment, wherein the ice bucket is removably mounted in the ice compartment, wherein the ice bucket has a front cover, and wherein the front cover has an open gasket disposed between the front cover and the ice compartment, such that at least some amount of air exchange is permitted to occur between the refrigerator compartment and the ice compartment.

According to another aspect, the open gasket comprises a labyrinth.

According to another aspect, the open gasket comprises a generally U-shape having an open portion facing one of up, down, left, or right disposed between the front cover and the ice compartment.

According to another aspect, the front cover has an opening in a bottom portion for discharging pieces of ice.

According to another aspect, the present disclosure provides a refrigerator comprising a refrigerator compartment; a freezer compartment; an ice compartment disposed in the refrigerator compartment; an ice maker disposed in the ice compartment; and an ice bucket for storing ice, the ice bucket being disposed in the ice compartment, wherein the ice compartment is formed by an L-shaped, insulated housing that cooperates with an inner side wall, an inner top wall, and an inner back wall of the refrigerator compartment, and wherein the L-shaped, insulated housing includes a vertical projection on an end of a horizontal portion of the L-shape, the vertical projection being configured to engage with a stepped portion of the inner side wall of the refrigerator compartment.

According to another aspect, the stepped portion is formed by making the inner side wall of the refrigerator compartment thicker at a region corresponding to an interior of the L-shaped, insulated housing as compared to a region of the inner side wall of the refrigerator compartment where the vertical projection engages and therebelow.

According to another aspect, the present disclosure provides a refrigerator comprising: a fresh food compartment; a freezer compartment, the refrigerator being a French door-bottom mount configuration having the fresh food compartment on top and the freezer compartment below the fresh food compartment; an ice compartment disposed in an upper corner of the fresh food compartment; an ice maker disposed in the ice compartment; and an ice bucket for storing ice, the ice bucket being disposed in the ice compartment, wherein the ice maker and the ice bucket are arranged side-by-side in a horizontal direction within the ice compartment, such that no portion of the ice bucket is located below the ice maker when the ice maker is projected downward in a vertical height direction.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 7B:
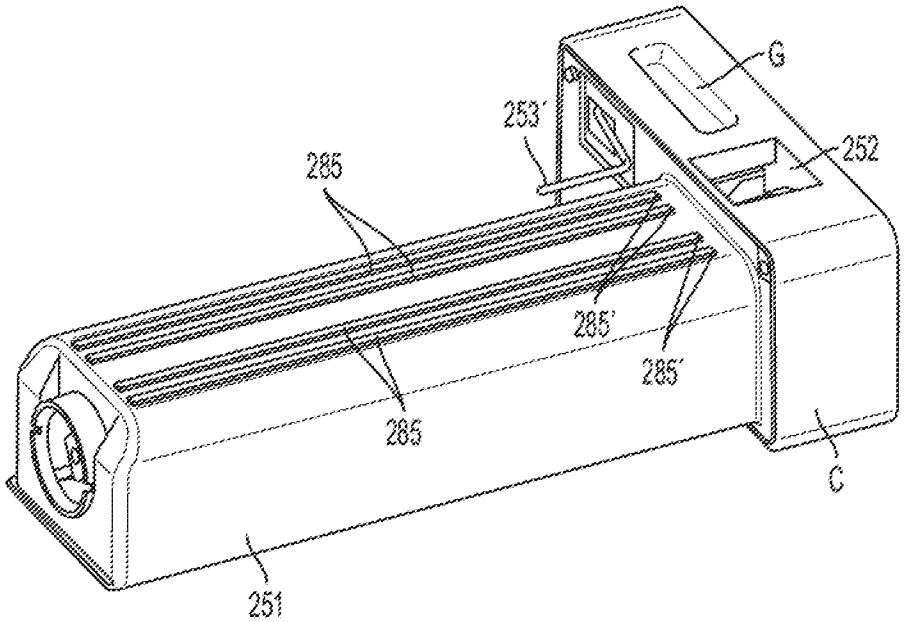
Figure 7A:
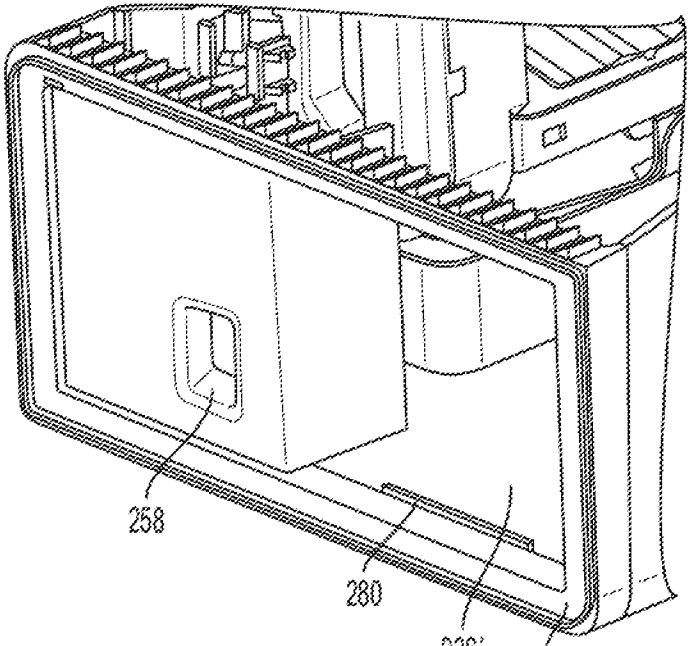
Figure 8:
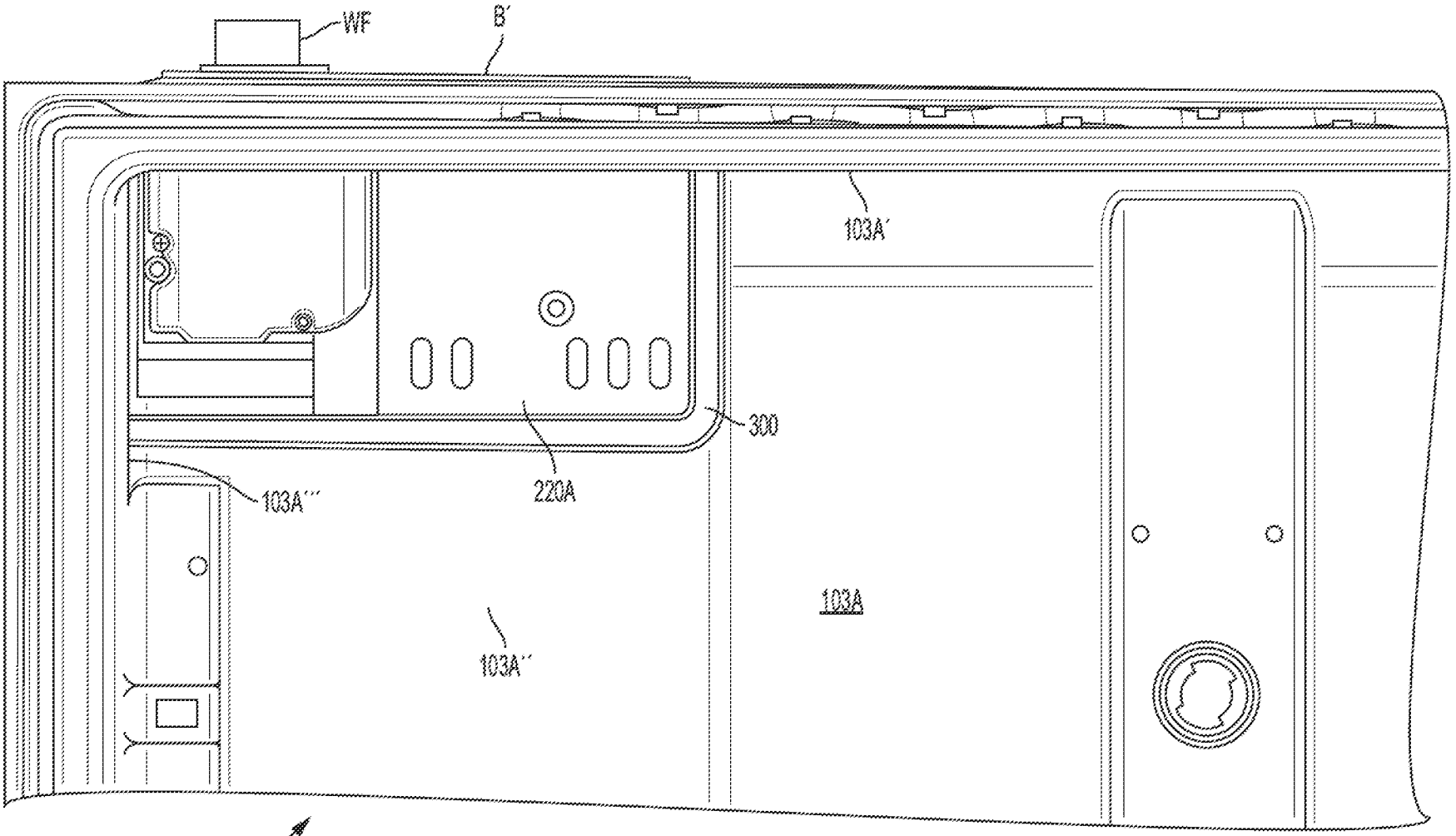
Figure 9B:
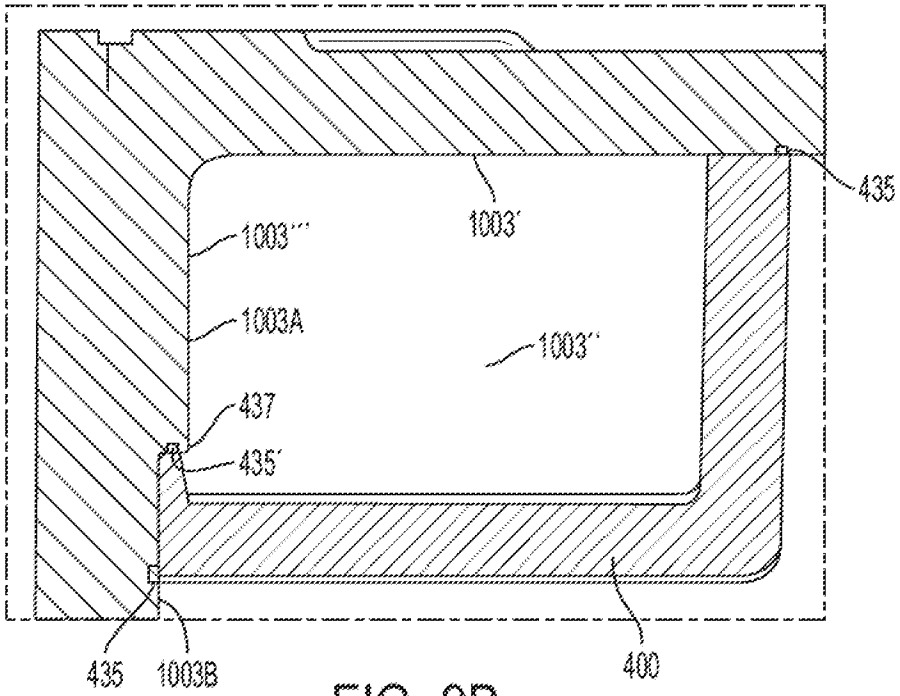
Figure 9A:
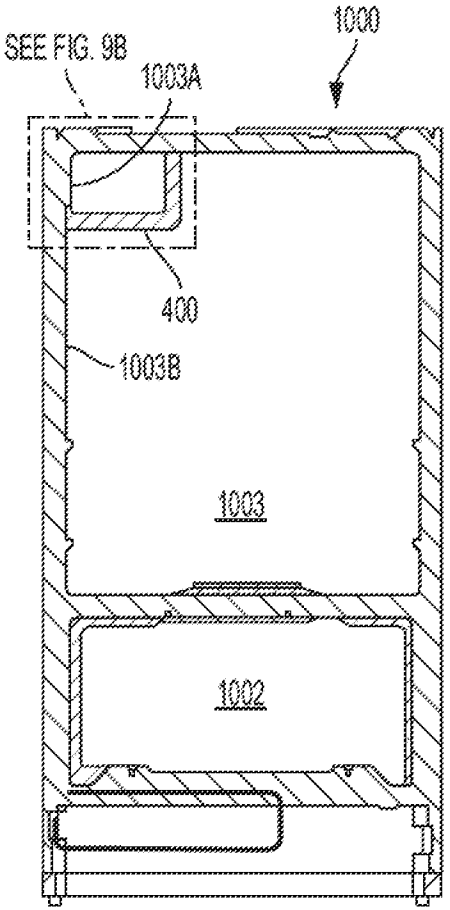
Figure 10B:
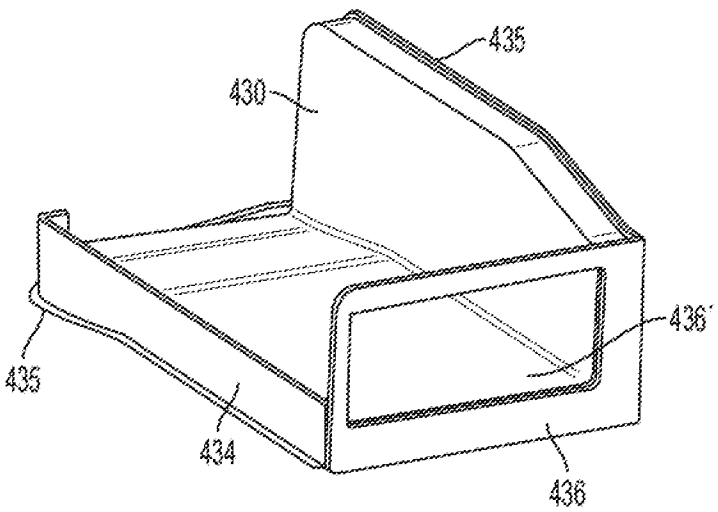
Figure 10A:
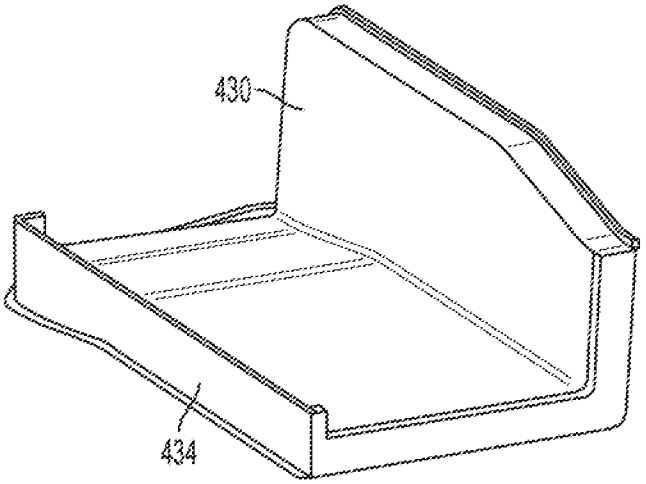
Figure 11B:
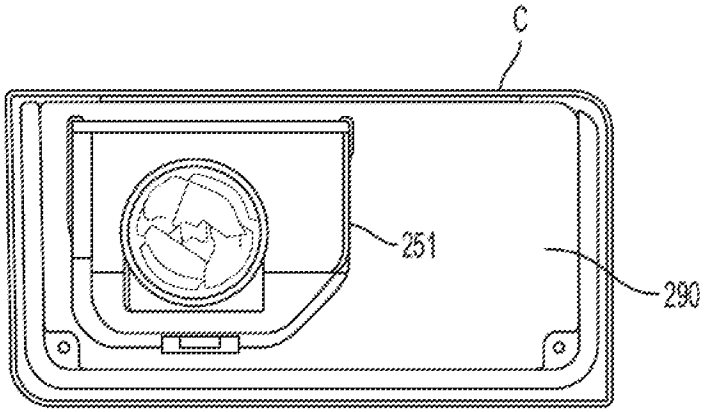
Figure 12B:
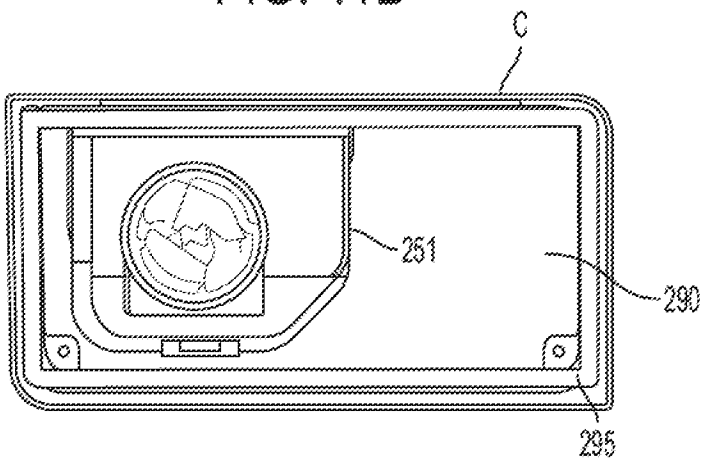
Figure 11A:
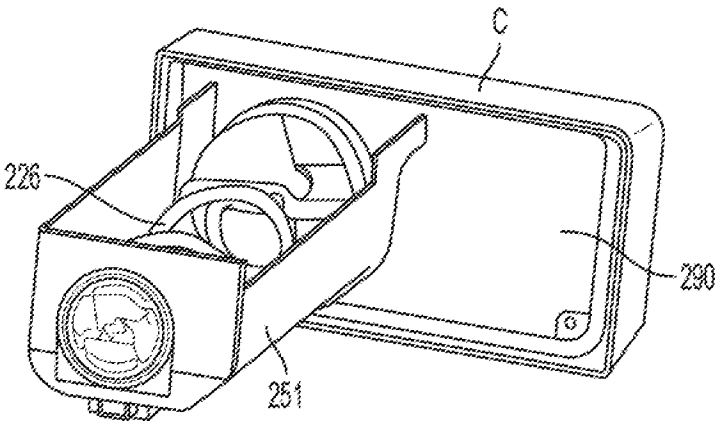
Figure 12A:
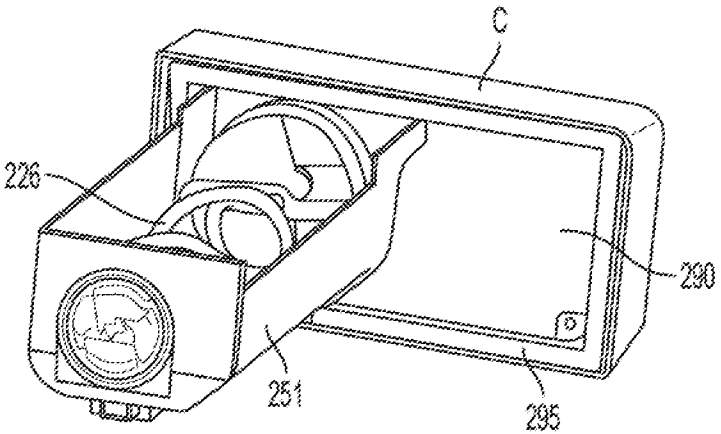
Figure 13B:
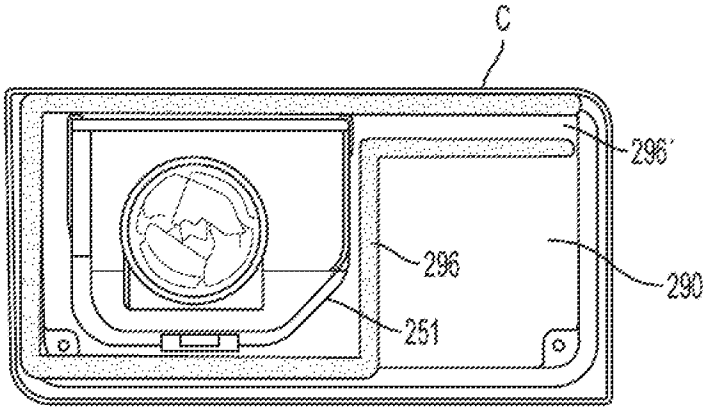
Figure 14B:
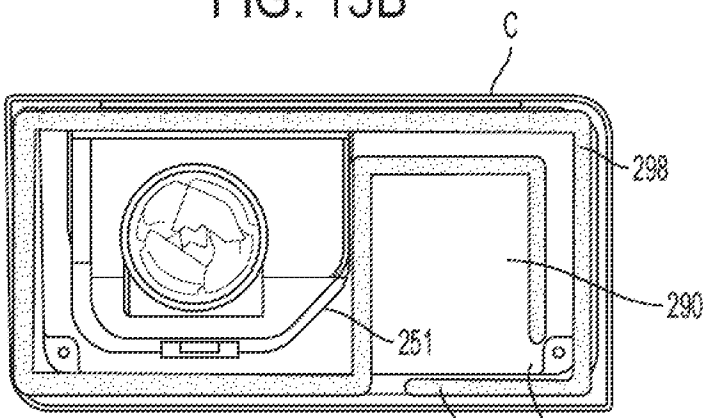
Figure 13A:
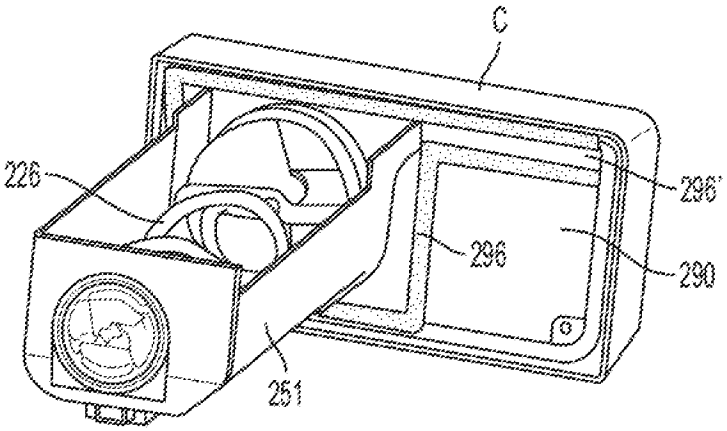
Figure 14A:
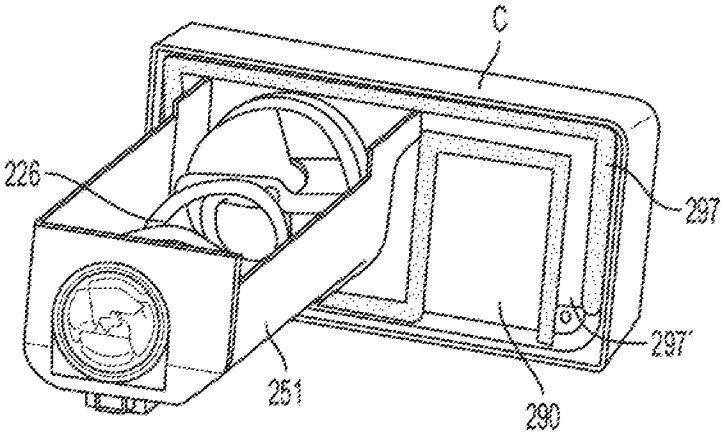
Figure 17B:
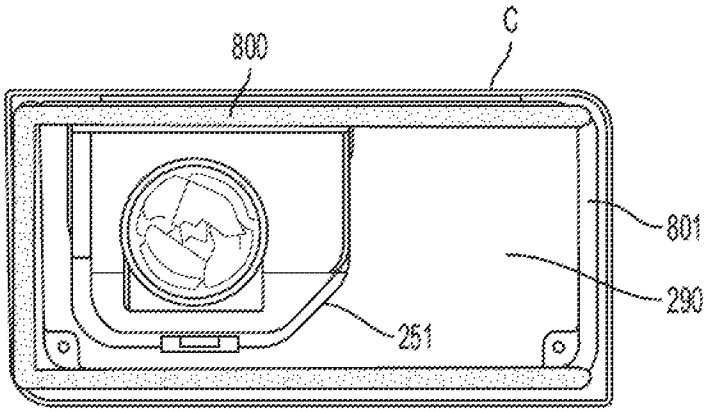
Figure 18B:
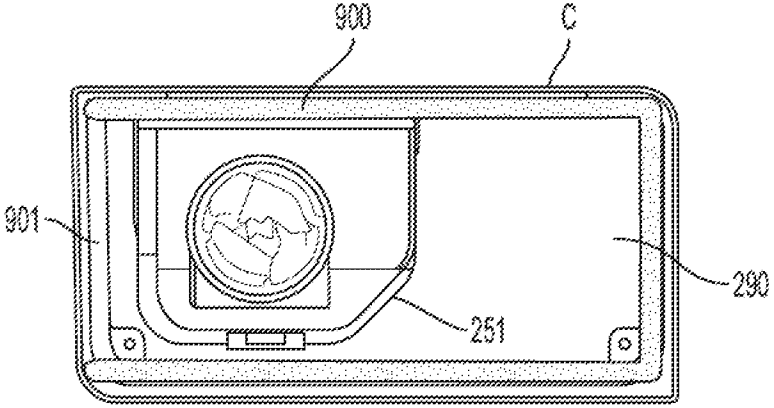
Figure 17A:
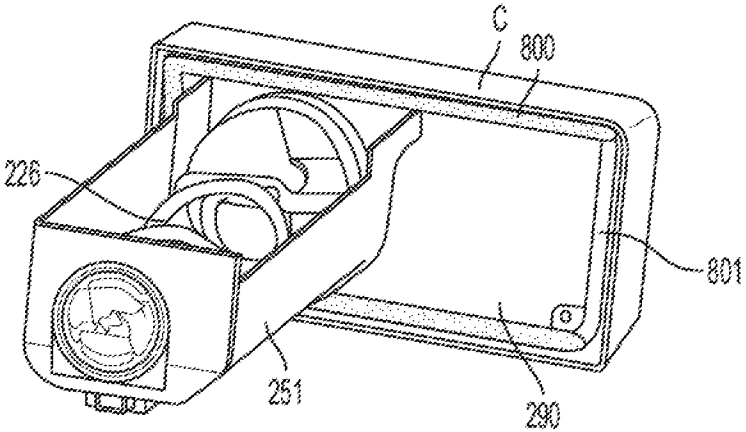
Figure 18A:
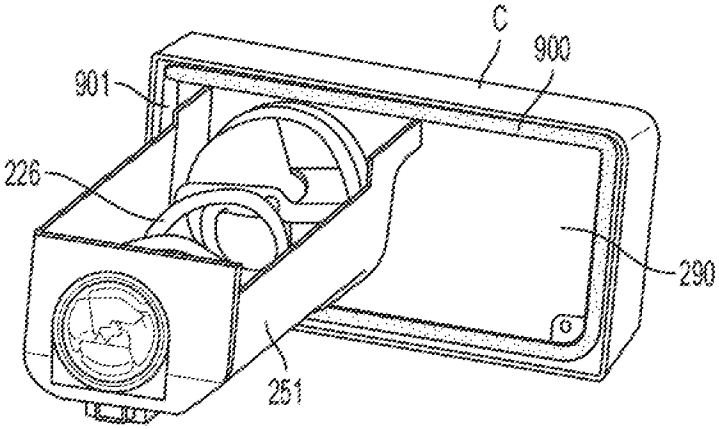
Figure 19:
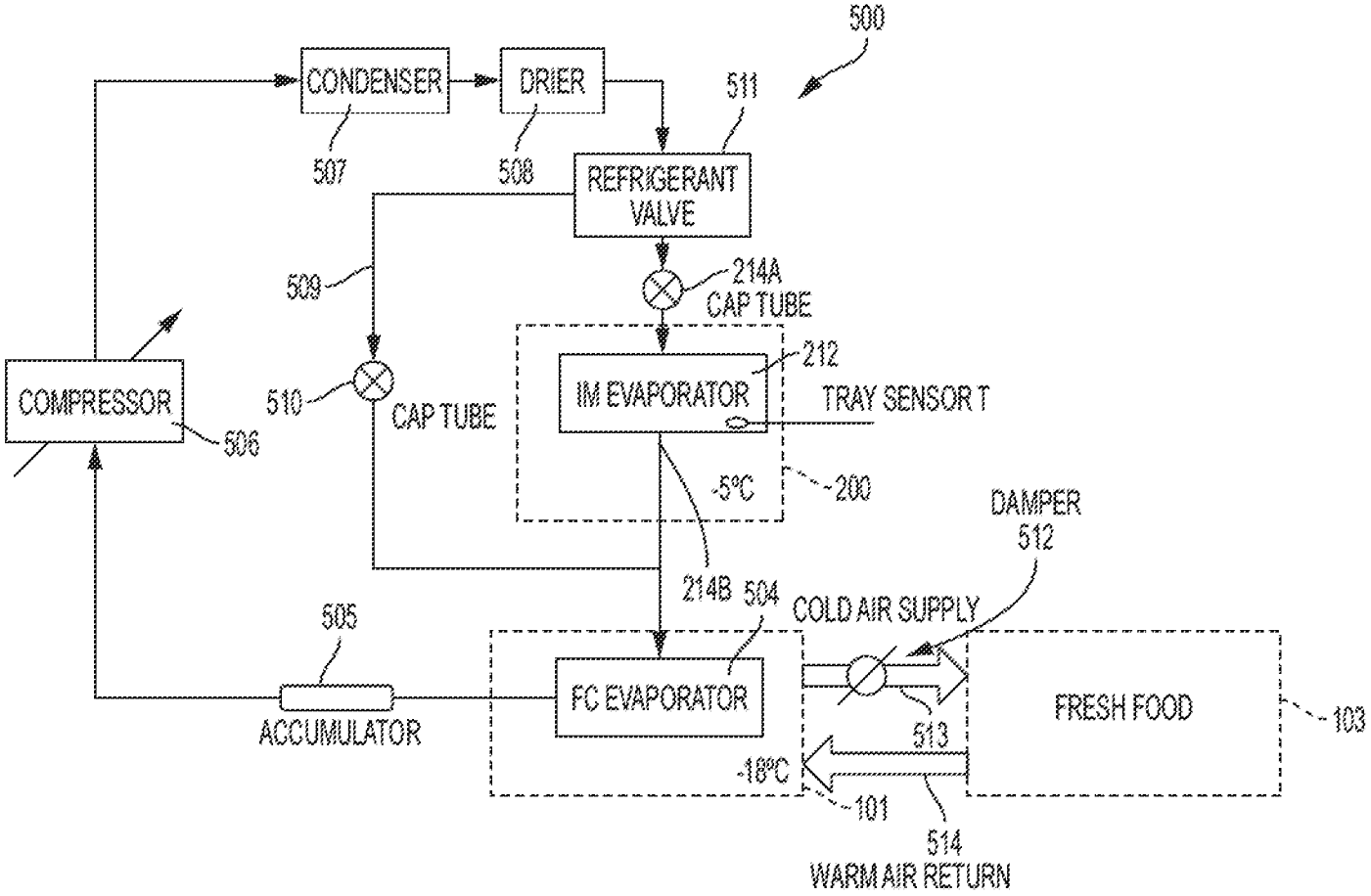

FIGS. 6A, 6B, 6C, and 6D are various views of an anti-rotation member disposed on a rear exterior wall of the ice bucket and which is configured to engage with a complementary member disposed at a rear portion of the ice compartment according to an exemplary embodiment consistent with present disclosure;

FIGS. 7A and 7B are various views of the housing collar and ice bucket with front cover according to an exemplary embodiment consistent with present disclosure;

FIG. 8 is a fragmentary front elevational view showing an L-shaped ice compartment with the ice bucket with front cover and the housing collar removed for ease of understanding according to an exemplary embodiment consistent with present disclosure;

FIGS. 9A and 9B are front cross-sectional views of a modified L-shaped ice compartment with the ice bucket with front cover and the housing collar removed for ease of understanding according to an exemplary embodiment consistent with present disclosure;

FIGS. 10A and 10B are perspective views of the modified L-shaped ice compartment assembly without and with the housing collar, respectively, according to an exemplary embodiment consistent with present disclosure;

FIGS. 11A and 11B show perspective and elevational views, respectively, of a rear portion of the front cover and ice bucket without a gasket according to an exemplary embodiment consistent with present disclosure;

FIGS. 12A and 12B show perspective and elevational views, respectively, of a rear portion of the front cover and ice bucket with a closed gasket according to an exemplary embodiment consistent with present disclosure;

FIGS. 13A and 13B show perspective and elevational views, respectively, of a rear portion of the front cover and ice bucket with an open gasket with a labyrinth according to an exemplary embodiment consistent with present disclosure;

FIGS. 14A and 14B show perspective and elevational views, respectively, of a rear portion of the front cover and ice bucket with variants of an open gasket with a labyrinth according to an exemplary embodiment consistent with present disclosure;

FIGS. 15A and 15B, 16A and 16B, 17A and 17B, and 18A and 18B show perspective and elevational views, respectively, of a rear portion of the front cover and ice bucket with variants of an open gasket with a generally U-shape facing up, down, right, and left, respectively, according to four exemplary embodiments consistent with present disclosure; and FIG. 19 shows a freezer compartment/icemaker refrigerant circuit according to an exemplary embodiment consistent with present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rearward, upper, lower, upward, downward, and the like used herein are for orientation purposes with respect to the drawings when describing the exemplary embodiments and should not limit the present invention. Also, terms such as substantially, approximately, and about are intended to allow for variances to account for manufacturing tolerances, measurement tolerances, or variations from ideal values that would be accepted by those skilled in the art.

Figure 1:
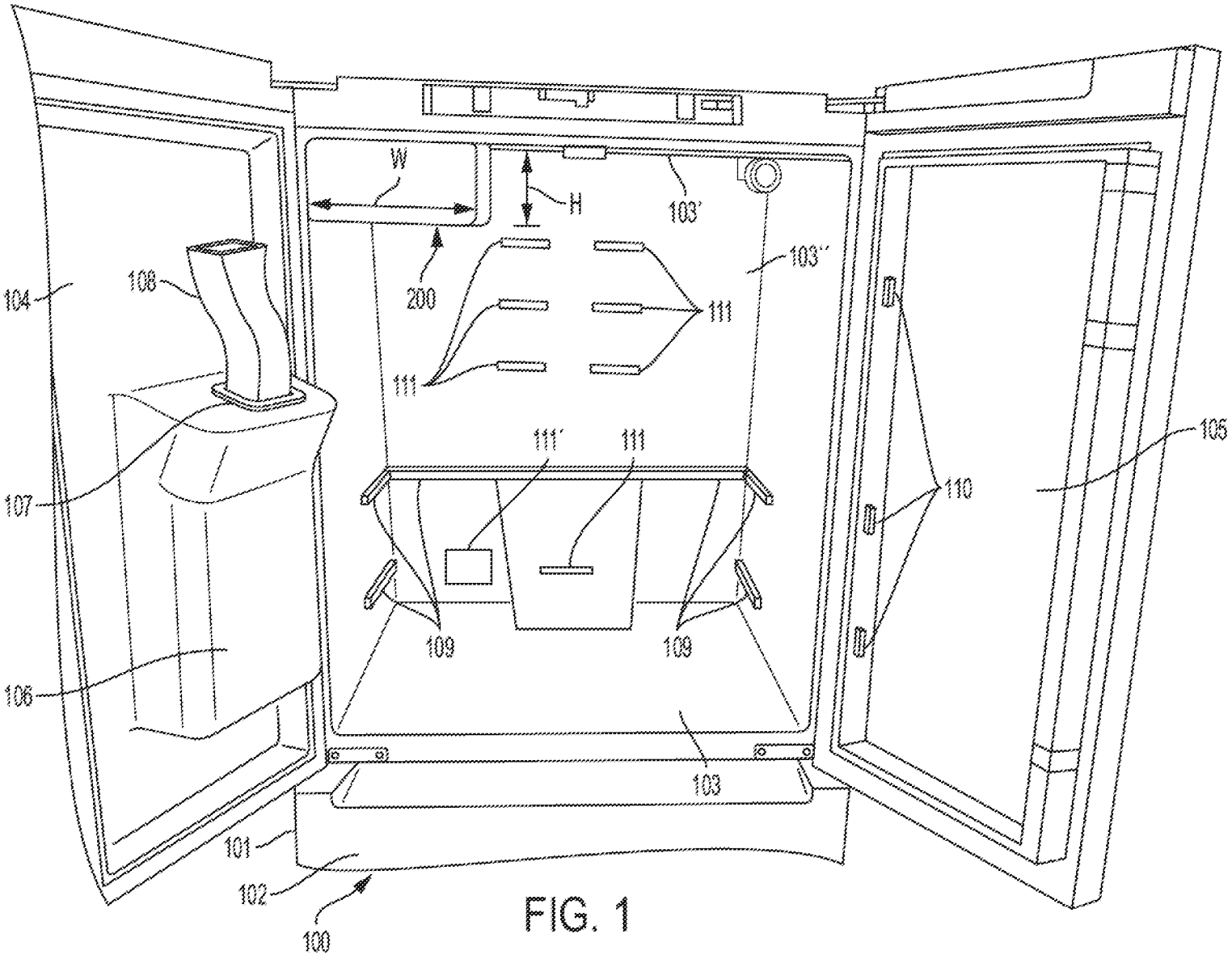
FIG. 1 illustrates a fragmentary front perspective view of a French door-bottom mount style refrigerator with the doors open to reveal the slimline ice compartment according to an exemplary embodiment consistent with present disclosure.

FIG. 1 illustrates a front perspective view of a French door-bottom mount style refrigerator 100 with the doors open to reveal the slimline ice compartment 200 according to an exemplary embodiment consistent with present disclosure. More specifically, the refrigerator 100 includes an insulated body having a freezer compartment 101 (bottom mount style) covered by a freezer door 102, and a fresh food compartment 103 (also referred to as a refrigerator compartment 103) located above the freezer compartment 101 and having two refrigerator doors 104 and 105 (French door style) which are shown in the open position. While two refrigerator doors are shown, clearly a single refrigerator door could be used, or more than two doors such as with door-in-door configurations. The shelves and food racks have been removed from inside the fresh food compartment 103 and from the inside of the refrigerator doors 104 and 105 for ease of understanding. The left door 104 includes a projecting housing portion 106 on the inner liner and which accommodates a water and ice dispenser assembly (not visible) accessible by the user on the front side of the door 104. An opening 107 of a dispenser ice chute (not visible) for guiding ice to the dispenser is arranged at the top of the projecting housing portion 106. As will be described in more detail below, the dispenser ice chute communicates with an opening in a front cover of the ice bucket via an ice chute extension 108. The inner liner side walls of the fresh food compartment 103 include protrusions 109 for supporting shelving (not shown). The right door 105 includes projections 110 for supporting door racks (not shown). Also shown in FIG. 1 are air openings 111 for cold air to enter into the fresh food compartment 103 (see the smaller elongated slots) and an opening 111' for return air to exit the fresh food compartment 103 (see the larger square opening on the bottom left). The freezer compartment is typically set at −18° C. or colder, and the fresh food compartment is typically set in a range of 1° C. to 4° C.

The slimline ice compartment 200 is disposed in an upper left hand corner of the fresh food compartment 103. The slimline ice compartment 200 can be located at other positions within the fresh food compartment 103, in one of the refrigerator doors 104, 105, or even in the freezer compartment 101 if desired, especially in a side-by-side freezer/refrigerator configuration. The slimline ice compartment 200 has a thin dimension in a vertical height direction H of approximately 5.6 inches±2.0 inches and has a horizontal width W of approximately 10.4 inches±2.0 inches.

Figure 2:
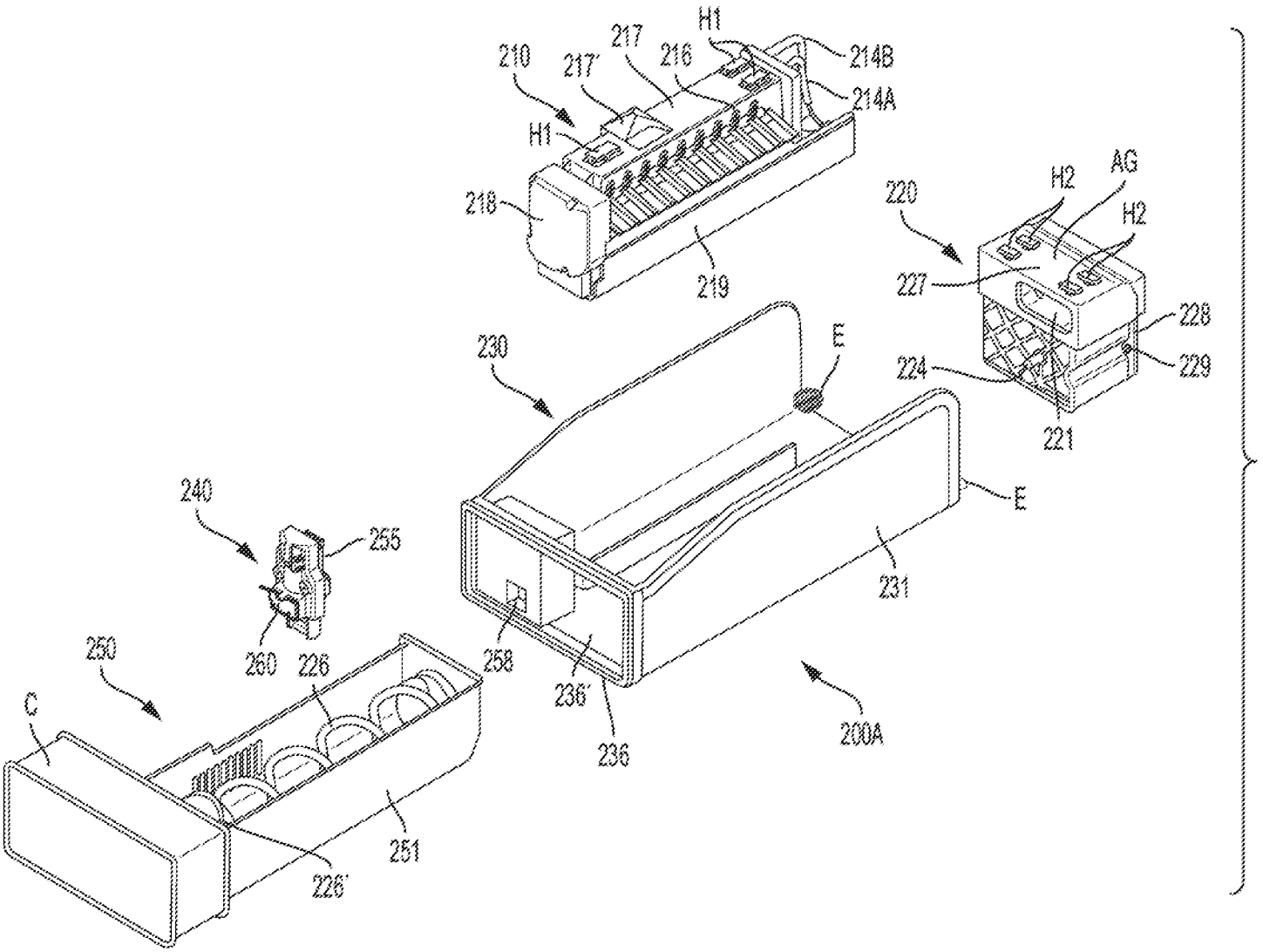
FIG. 2 is an exploded perspective view of the complete ice maker/ice bucket/ice compartment assembly according to an exemplary embodiment consistent with present disclosure.
Figure 3A:
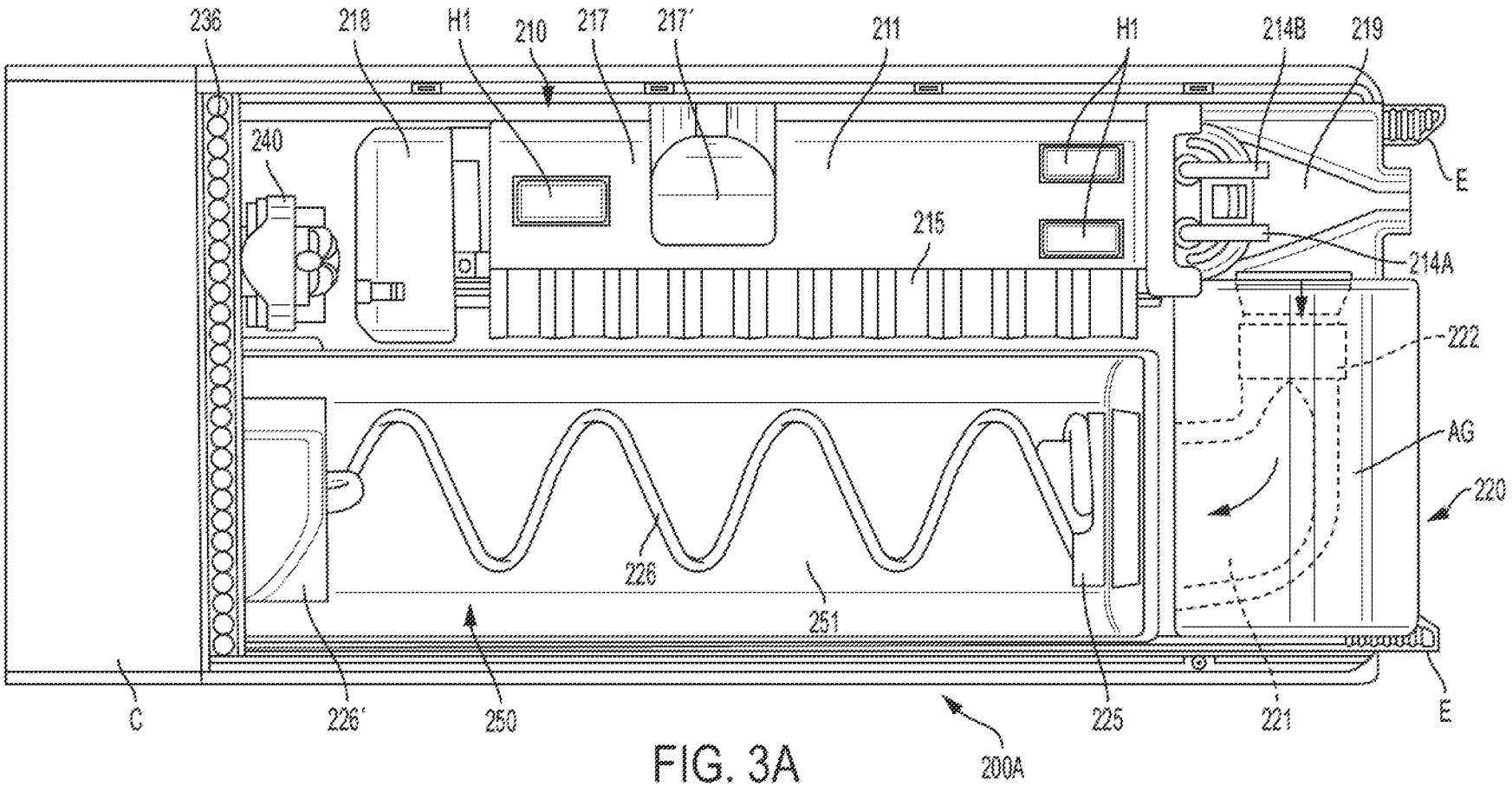
FIG. 3A is a top view of the complete ice maker/ice bucket/ice compartment assembly according to an exemplary embodiment consistent with present disclosure.

FIG. 2 is an exploded perspective view of the complete ice maker/ice bucket/ice compartment assembly 200A (hereinafter referred to as "the complete ice maker compartment assembly 200A") according to an exemplary embodiment consistent with present disclosure. More specifically, the complete ice maker compartment assembly 200A includes an ice maker assembly 210, an air handler/auger motor assembly 220, an ice compartment housing assembly 230, a cube/crush DC motor and reed switch assembly 240, and the ice bucket assembly 250. FIG. 3A is a top view of the complete ice maker compartment assembly 200A according to an exemplary embodiment consistent with present disclosure. Aspects of each of the individual assemblies 210-250 will be discussed in more detail below in connection with the remaining drawings.

Figure 3B:
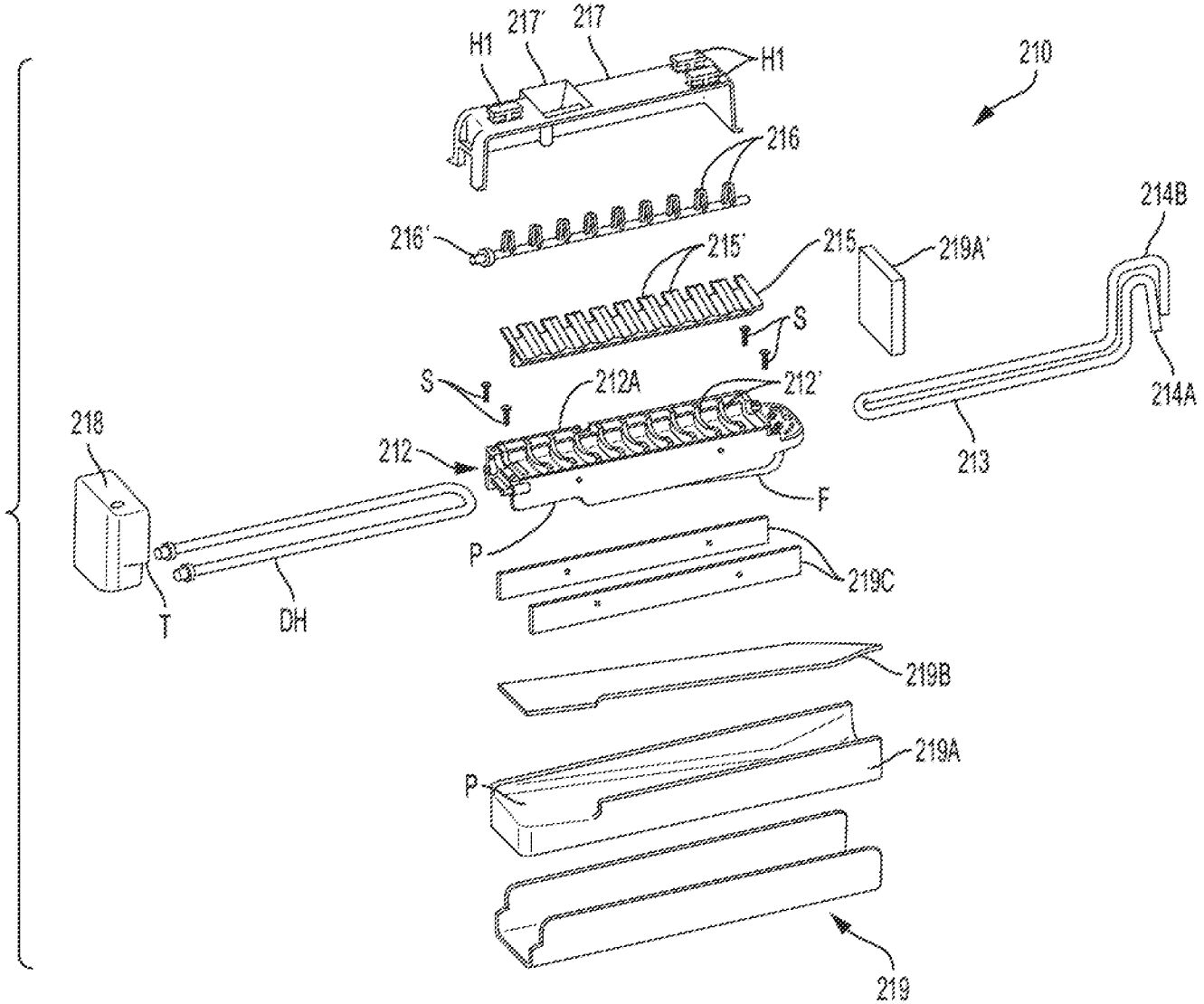
FIG. 3B is an exploded perspective view of the ice maker assembly according to an exemplary embodiment consistent with present disclosure.

As shown in FIGS. 2, 3A, and 3B, the ice maker assembly 210 (which includes an ice maker 211) and the ice bucket assembly 250 (which includes an ice bucket 251) are arranged side-by-side or next to each other in a horizontal direction within the ice compartment housing assembly 230. In other words, no portion of the ice bucket 251 is located below the ice maker 211 when the ice maker 211 is projected downward in a vertical height direction.

As best shown in FIG. 3B, the ice maker assembly 210 includes an ice maker tray/evaporator 212 having an evaporator cooling tube 213 (formed of at least one of copper or a copper alloy, for example) which is, for example, die cast over-molded inside an ice maker tray portion 212A (formed of at least one of aluminum, an aluminum alloy, or other die cast alloys, for example), such that the evaporator cooling tube 213 is embedded in and thus in direct contact with the ice maker tray portion 212A so as to form the ice maker tray/evaporator 212 as a one piece unit. Preferably, but not necessarily, the evaporator cooling tube 213 is formed of copper and the ice maker tray portion 212A is formed of aluminum. Alternatively, the ice maker tray/evaporator 212 is made in two halves. The evaporator cooling tube 213 has an evaporator tube inlet 214A with a capillary connection (i.e., the end is swaged and connected to a capillary tube), and an evaporator cooling tube outlet (suction tube) 214B.

As shown in FIG. 19, the evaporator cooling tube 213 (see FIG. 3B) is connected in a refrigerant circuit 500. The refrigerant circuit 500 includes the ice maker tray/evaporator 212 connected by the evaporator cooling tube outlet (suction tube) 214B in series with a freezer compartment evaporator 504 which is in turn connected to an accumulator 505, a compressor 506, a condenser 507, and a drier 508, and then connects to the evaporator tube inlet 214A having the capillary connection. The refrigerant circuit 500 also includes a bypass line 509 with capillary tube 510 and a refrigerant valve 511 which is located prior to the evaporator tube inlet 214A with the capillary connection in order to bypass the ice maker tray/evaporator 212 and communicate the refrigerant to the freezer compartment evaporator 504. The evaporator tube inlet 214A and the evaporator cooling tube outlet 214B are joined to the foamed-in refrigerator cabinet tubes (which are disposed in the insulated space at the rear of the refrigerator 100) by brazing or by a lock ring. The fresh food compartment 103 can use cold air selectively ducted by a damper 512 in a cold air supply 513 from the freezer compartment 101 and returned in a warm air return 514 (see FIG. 19), or can be part of a separate, independent refrigerant circuit having its own compressor, condenser, drier, capillary tube, and evaporator.

The ice maker tray/evaporator 212 includes a mold with a plurality of cavities 212' for receiving water for making ice pieces. The ice maker tray/evaporator 212 includes molded evaporator fins F extending vertically downward from the bottom thereof. An ice maker guard 215 is fastened to the side of the ice maker tray/evaporator 212 facing the ice bucket 251. The ice maker guard 215 includes a plurality of projections or fingers 215'. Ejector fingers 216 are arranged on a rotatable shaft 216' and are movable in spaces between the projections 215'. An ice maker bracket 217 is disposed above the mold with a plurality of cavities 212' and includes a water fill cup 217' for directing water into the cavities 212'. The ice maker bracket 217 is attached via fasteners (for example, four screws S) to the ice maker tray/evaporator 212. The ice maker bracket 217 also includes a plurality (for example three) of mounting hooks H1 on a top surface thereof for engaging corresponding mounting members (not shown) formed in a foamed-in bracket B (see FIG. 4B) which is part of the refrigerator structure. The mounting hooks H1 allow the ice maker assembly 210 to be easily assembled to an inner top wall or liner 103' of the fresh food compartment 103 via the foamed-in bracket B. A wire harness (not shown) for connecting the ice maker 211 to the refrigerator 100 may be connected to corresponding connectors (not shown) in, for example, the inner top wall 103' of the fresh food compartment 103 at a location within the ice compartment 200.

A defrost heater DH in the form of a loop is disposed under the ice maker tray/evaporator 212 and is operative to heat the ice maker tray/evaporator 212 during a harvest mode to release the pieces of ice for harvesting the pieces of ice and also serves to prevent any ice or frost buildup on the ice maker tray/evaporator 212 including underneath the same and including on the evaporator fins F and a defrost tray formed by metal drain plate 219B described below. The defrost heater DH can be easily replaced when service is required.

As shown in FIG. 3B, a gear box 218 is positioned at a front end portion (facing the front of the refrigerator) of the ice maker tray/evaporator 212 and includes gears and a motor (not shown) for driving the rotatable shaft 216' and the bail arm or optical sensor system (not shown) that senses the amount of ice pieces in the ice bucket 251. A temperature or tray sensor such as a thermistor T is disposed on an outer portion of the gear box 218 facing the ice maker tray/evaporator 212 (see FIG. 3B). Alternatively, the thermistor T can be disposed directly on the ice maker tray/evaporator 212 (see FIG. 19). In this regard, there is no air temperature control inside the slimline ice compartment 200, rather the ice maker tray/evaporator 212 and motor driven fan 222 (see FIG. 3A) within the ice compartment 200 are controlled using the thermistor T which directly monitors the ice/ice maker tray/evaporator 212 temperatures to cycle the motor driven fan 222 and bi-stable refrigerant valve 511 "ON" and "OFF" in order to keep the temperature inside the ice compartment 200 within established limits. Moreover, instead of just the one thermistor T, an additional temperature sensor (not shown) may be disposed inside the gear box 218 and sense the temperature of the plastic housing of the gear box 218. Still further, the additional temperature sensor (not shown) may be built into a body of the electric motor driven fan 222.

A drain assembly 219 having insulation 219A and 219A' (formed from, for example, expanded polypropylene (EPP)), a metal (for example, aluminum) drain plate 219B, and a collar 219C is positioned under and attached with the ice maker tray/evaporator 212. While the metal drain plate 219B is shown in FIG. 3B as a flat metal plate, it can also be form-fitted to the insulation 219A to form the defrost tray. The drain assembly 219 is configured with an angle toward the rear so as to drain any water from a defrost mode of the ice maker 211 away from a rear end portion of the ice maker assembly 210 and communicates with tubing (not shown) which in turn communicates with an evaporation tray (not shown) in a machine room of the refrigerator 100. The drain assembly 219 also cooperates with the bottom of the ice maker tray/evaporator 212 to form an airflow passage P under the ice maker tray/evaporator 212 and through the evaporator fins F.

Figure 4B:
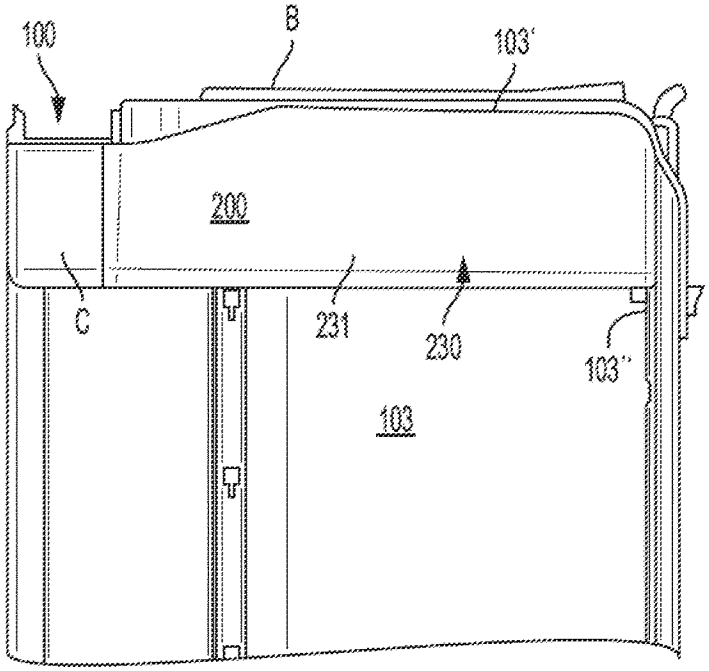
FIG. 4B is a fragmentary side elevational view showing the exterior of the ice compartment inside the refrigerator compartment according to an exemplary embodiment consistent with present disclosure.
Figure 4A:
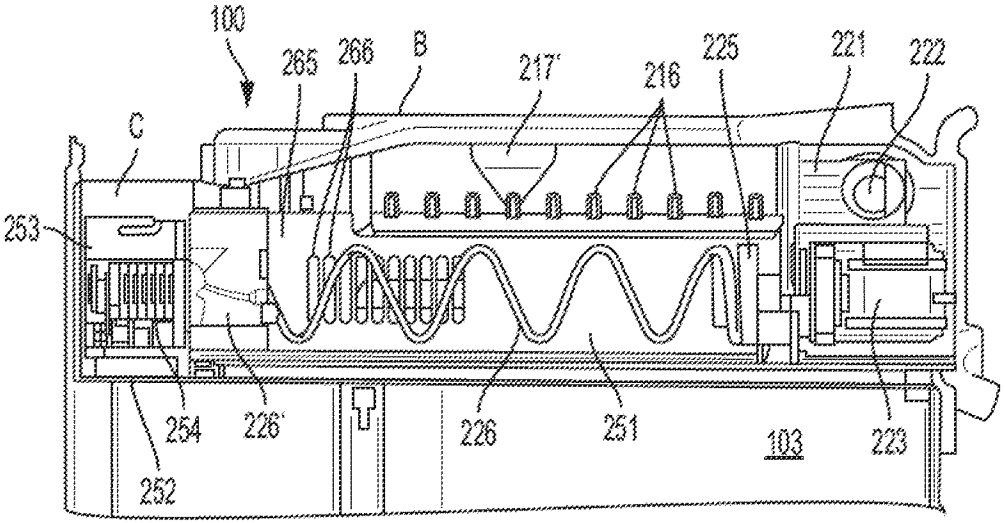
FIG. 4A is a fragmentary cutaway side elevational view showing the complete ice maker/ice bucket/ice compartment assembly according to an exemplary embodiment consistent with present disclosure.

With reference to FIGS. 2, 3A, and 4A, the air handler/auger motor assembly 220 is disposed at the rear portion of the slimline ice compartment 200. The air handler/auger motor assembly 220 includes an air guide AG with an air passage 221 having an electric motor driven fan 222 disposed therein. Although the electric motor driven fan 222 is shown with a vertical orientation, the electric motor driven fan 222 can also be oriented horizontally in a vertical portion of the air passage 221. The air passage 221 is located at an upper portion of the air handler/auger motor assembly 220. The air passage 221 communicates with the airflow passage P under the ice maker tray/evaporator 212. An inlet of the electric motor driven fan 222 communicates with the airflow passage P under the ice maker tray/evaporator 212 and through the evaporator fins F such that the electric motor driven fan 222 creates a suction and draws cool air from the ice maker tray/evaporator 212 and discharges the cool air through the air passage 221 and either over or around the ice bucket 251 to prevent the ice pieces from melting. The cool or cold air that circulates inside the ice compartment 200 is only required to keep the ice compartment 200 cold enough to prevent ice stored in the ice bucket 251 from melting which is normally below −3° C. and preferably, but not necessarily, around −5° C. The air flow passage 221 makes a substantially 90 degree turn and widens prior to emptying into the ice bucket 251. An auger motor 223 is located at a lower portion of the air handler/auger motor assembly 220. The auger motor 223 includes a motor shaft 224 that is connected via a coupler 225 to an auger member 226 such as a coiled auger wire or tube or the like. The other end of the auger member 226 is connected to an auger drum 226' which guides the ice pieces to the crushing blades and the opening in the front cover which are discussed later.

The air handler/auger motor assembly 220 includes a plurality (for example four) of mounting hooks H2 on the top surface 227 (see FIGS. 2 and 6B) for engaging corresponding mounting members (not shown) formed in the foamed-in bracket B which is part of the refrigerator structure for mounting the air handler/auger motor assembly 220 to the fresh food compartment 103. The air handler/auger motor assembly 220 may also include one or more vertical mounting plates 228 with fastener holes 229 (see FIG. 6B) for further mounting the air handler/auger motor assembly 220 to an inner back wall or liner 103" of the fresh food compartment 103 via fasteners such as screws (not shown).

Figure 5A:
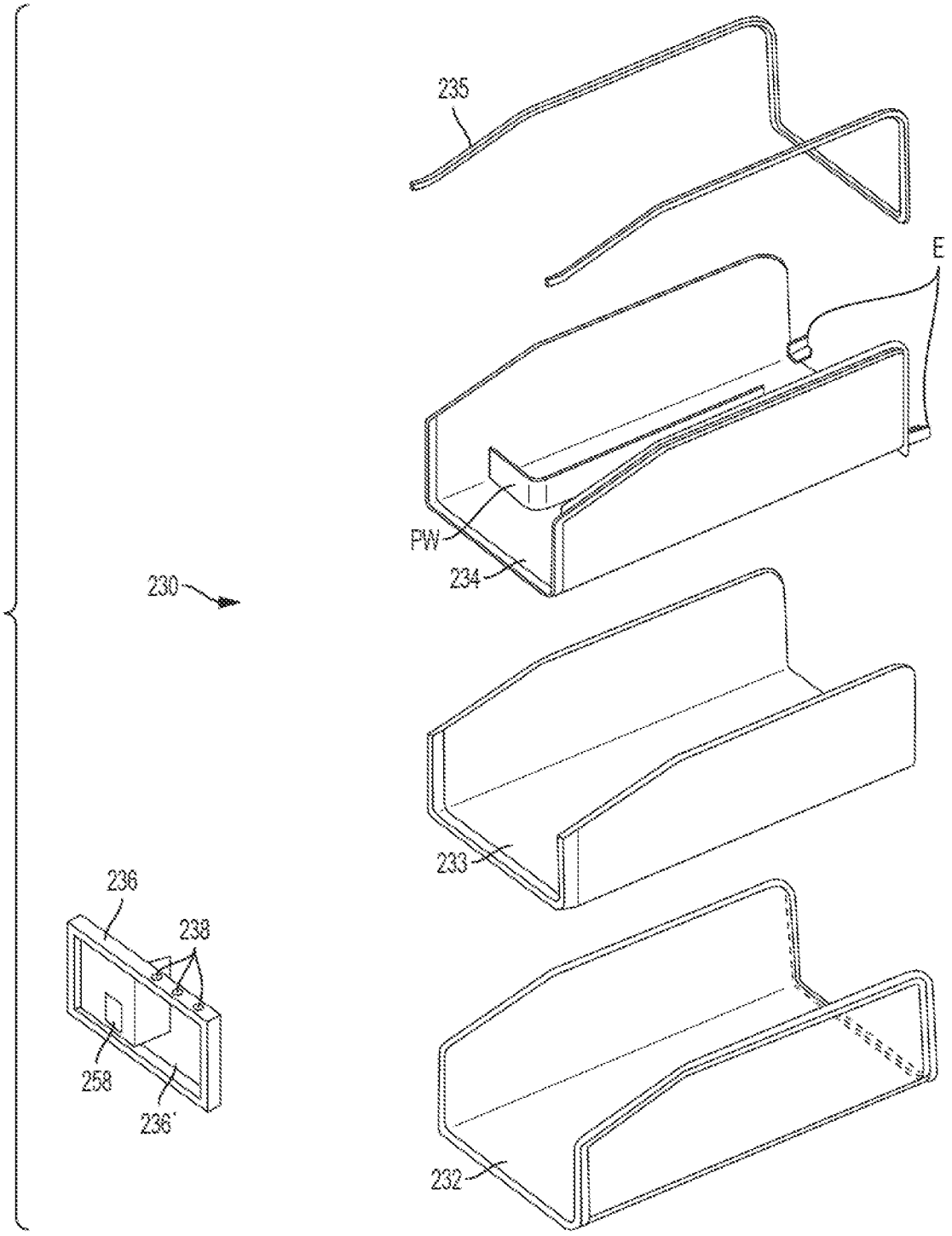
FIG. 5A is an exploded perspective view of a U-shaped ice compartment assembly according to an exemplary embodiment consistent with present disclosure.

As best shown in FIGS. 2, 4B, and 5A, one embodiment of the ice compartment housing assembly 230 is formed by a U-shaped, insulated housing 231 that cooperates with the inner top wall 103' and the inner back wall 103" of the fresh food compartment 103. As best shown in FIG. 4B, the U-shaped, insulated housing 231 is contoured to fit the shape of the inner top wall 103' and an inner back wall 103" of the fresh food compartment 103. The U-shaped, insulated housing 231 includes a U-shaped outer wall 232, a U-shaped insulation 233 (formed of, for example, expanded polypropylene (EPP), expanded polystyrene (EPS), vacuum insolated panel (VIP)), a U-shaped inner wall 234, a gasket 235 that is disposed between an edge of the U-shaped, insulated housing 231 and the inner top wall 103' and the inner back wall 103" of the fresh food compartment 103, and a housing collar 236 that is disposed on an open front portion of the U-shaped, insulated housing 231, the housing collar 236 having an opening 236' therein for receiving the ice bucket 251. The gasket 235 may be an extruded gasket formed from, for example, polyvinyl chloride (PVC) that is rubberized, and that is inserted into a groove that is formed along the edge of the U-shaped, insulated housing 231.

Figure 5B:
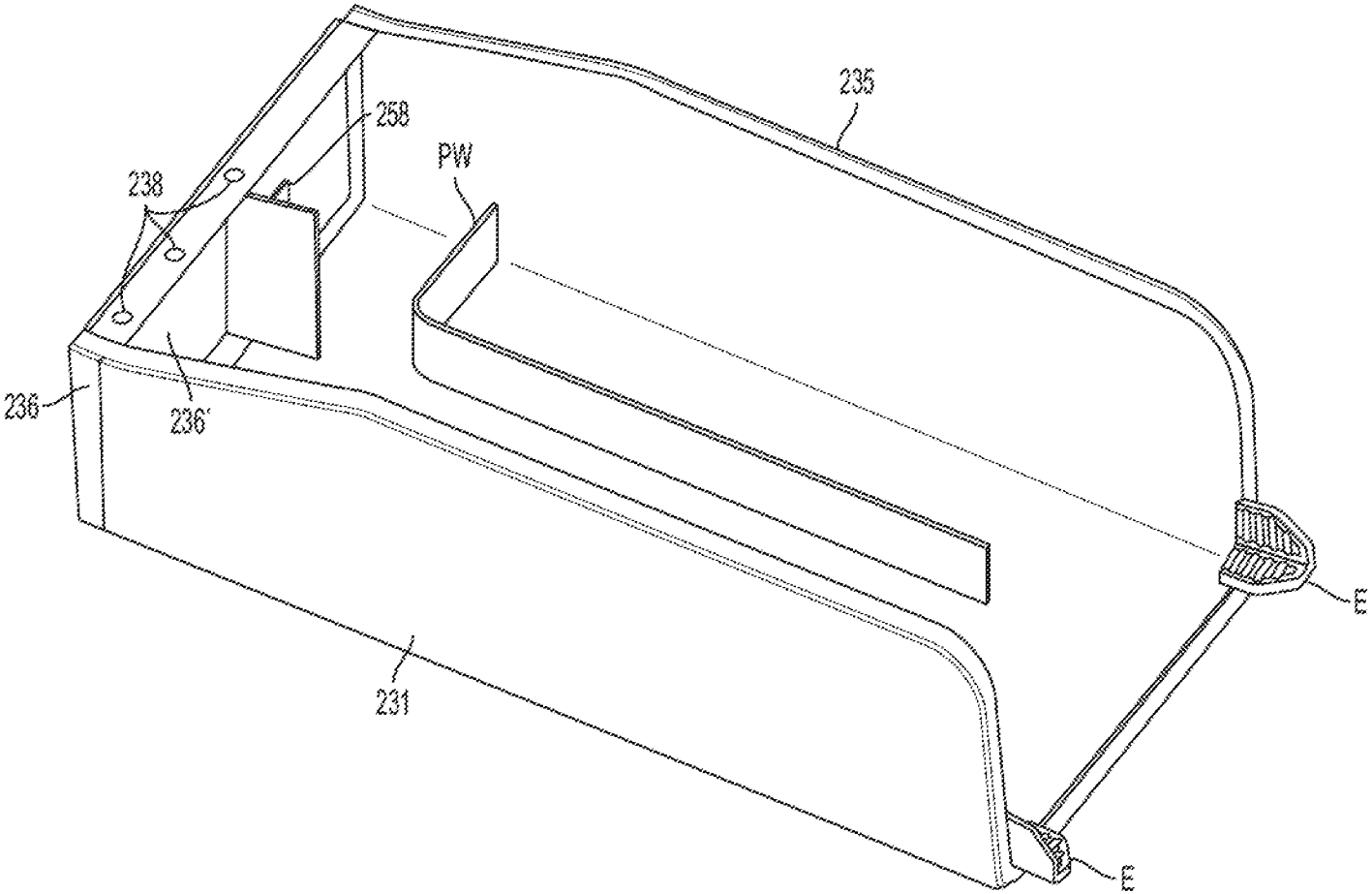
FIG. 5B is a perspective view of the U-shaped ice compartment with locating features according to an exemplary embodiment consistent with present disclosure.
Figure 5C:
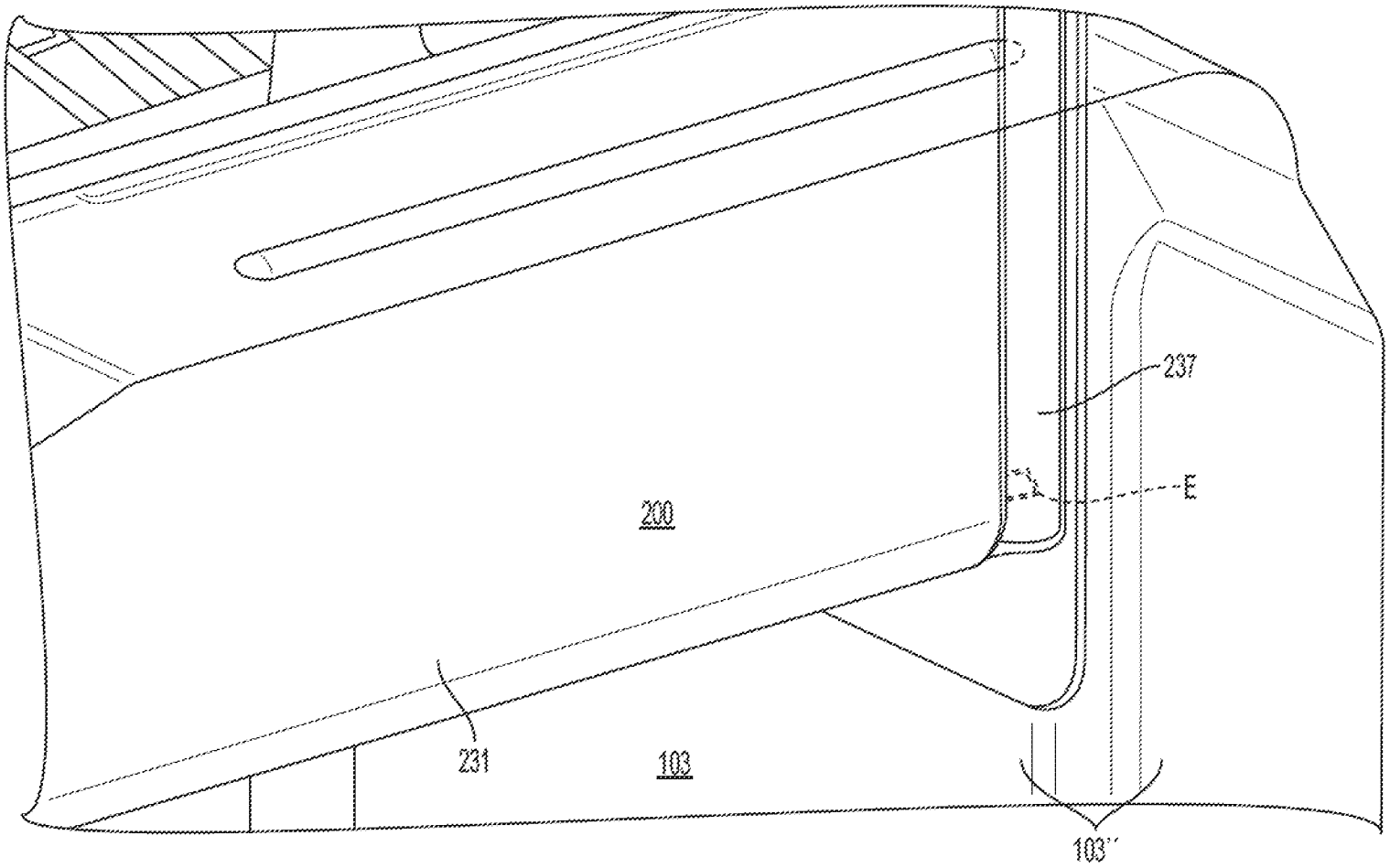
FIG. 5C is an enlarged perspective view of the U-shaped ice compartment with locating features positioned in place according to an exemplary embodiment consistent with present disclosure.
Figure 5D:
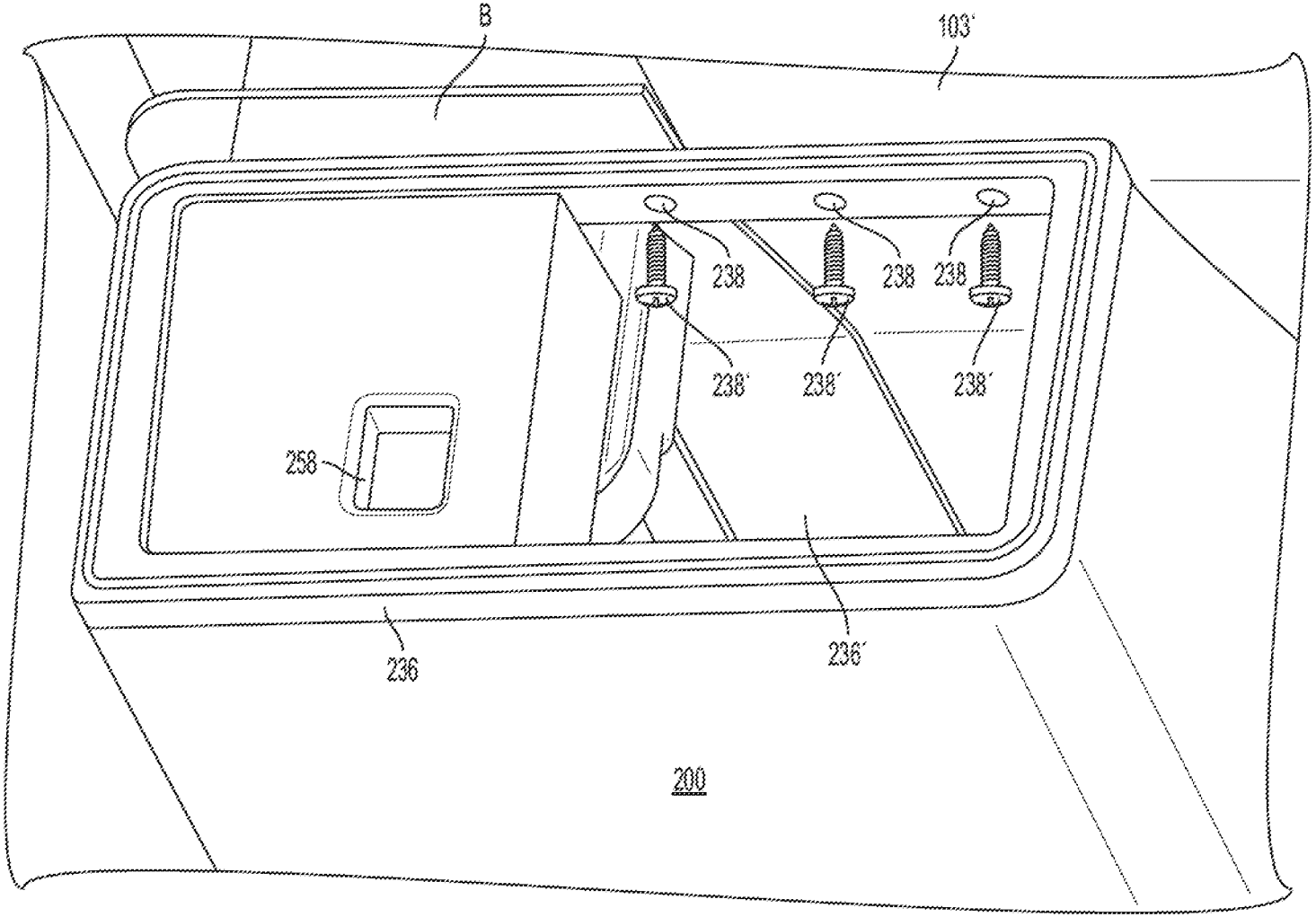
FIG. 5D is an enlarged front perspective view of the U-shaped ice compartment with housing collar in place according to an exemplary embodiment consistent with present disclosure.

With reference to FIGS. 5B-5D, the U-shaped, insulated housing 231 includes an inner L-shaped positioning wall PW for positioning the U-shaped, insulated housing into position over the ice maker assembly 210. The U-shaped, insulated housing 231 also includes locating extensions E (for example, two extensions E) extending from a lower rear portion of the edge, the locating extensions E being configured to fit into a bracket 237 (see FIG. 5C) positioned in the inner back wall 103" of the fresh food compartment 103. Moreover, the housing collar 236 having the opening 236' therein for receiving the ice bucket 251 further includes a plurality of fastener holes 238 configured to receive fasteners (for example, three screws 238') for fastening the U-shaped, insulated housing 231 to the inner top wall 103' of the fresh food compartment 103 (see FIG. 5D). With such a construction, the U-shaped, insulated housing 231 is slid into position in the upper left hand corner of the fresh food compartment 103 and over the ice maker assembly 210 and then held in place by the locating extensions E at the lower rear portion and the fasteners 238' in the holes 238.

With reference to FIGS. 2, 3A, 4A, and 7B, the cube/crush DC motor and reed switch assembly 240 is disposed within the ice compartment housing assembly 230 at a location in front of the ice maker assembly 210 and is mounted, for example, to a back wall of the housing collar 236 or similar. The cube/crush DC motor and reed switch assembly 240 is used to control whether cubed or crushed ice is delivered to the user. More specifically, the ice bucket or bin 251 has an ice bucket outlet opening 252 (seen from bottom) in a front cover C through which ice pieces are delivered, as will be described in more detail below. The ice bucket outlet opening 252 has an ice gate 253 that pivots, such that the ice gate 253 opens or closes. When the ice gate 253 is closed, it forces the ice pieces, such as in the shape of cubes, towards a plurality of crushing blades 254 (for example, when "crushed" ice is selected by the user). On the other hand, when "cubed" ice is selected by the user, the ice gate 253 opens thus allowing the ice cubes to come out through the ice bucket outlet opening 252 missing the crushing blades. The default position for the ice gate 253 is closed, and this minimizes any ice cubes from falling out through the ice bucket opening 252 when the user pulls out the ice bucket 251. This also prevents the user from touching the blades while pulling out the ice bucket 251. The pivoting of the ice gate 253 is carried out by a rod 253' (see FIG. 7B) that engages into an actuator head that is controlled by a cube/crush DC reversible motor 255 (for example, a 12 volt DC reversible electric motor) that moves up (closing the ice gate 253) and down (opening the ice gate 253). The rod 253' passes through an opening 258 in the housing collar 236 (see FIGS. 2, 5D, and 7A). The ice bucket assembly 250 has a magnet (not shown) that is disposed in the front cover C of the ice bucket 251 and that interfaces with a reed switch 260 that is assembled on a motor bracket of the cube/crush DC reversible motor 255. Accordingly, when the ice bucket 251 is removed from the opening 236' in the housing collar 236 of the ice compartment 200, the reed switch 260 opens the circuit thereby disabling: any ice dispensing, the ice maker 211, and the motor driven fan 222. This in turn prevents any ice harvesting while the ice bucket 251 is not present, and also minimizes moisture ingress inside the ice compartment 200. Once the ice bucket 251 is placed back into the ice compartment housing assembly 230, the normal operation is resumed.

With reference to FIGS. 2, 3, 4A, 6A-6D, 7A, and 7B, the ice bucket assembly 250 includes the ice bucket or bin 251 for storing ice pieces and in which the auger member 226 is disposed, and the front cover C. As noted above, the ice bucket 251 is removably mounted in the slimline ice compartment 200. As shown in FIG. 4A, in one embodiment, an inner side wall 265 of the ice bucket 251 is formed with a plurality of through-holes or slots 266 which allow the air that has cooled the ice to exit the ice bucket 251 and enter at a front end portion of the airflow passage P under the ice maker tray/evaporator 212 to be cooled again. As noted above, the front cover C has the ice bucket outlet opening 252 on the bottom through which ice pieces are delivered when a user dispenses ice pieces. The ice bucket outlet opening 252 cooperates with the ice chute extension 108 to deliver ice pieces to the dispenser when the door 104 is in a closed position. The interface between the ice bucket outlet opening 252 and the top of the ice chute extension 108 can be sealed with a gasket, have a partial or open gasket, or have no gasket at all. In the latter two cases, some air is permitted to move between the fresh food compartment 103 and the ice compartment 200 by moving into the region inside the ice chute extension 108 and through the ice bucket outlet opening 252 and into the ice compartment 200 and vice versa.

Figure 6C:
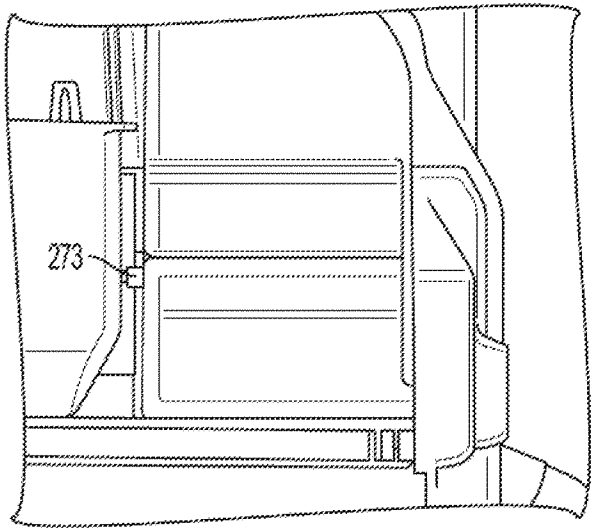
Figure 6D:
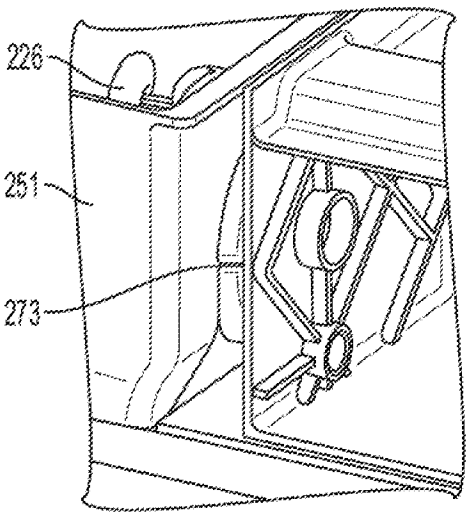
Figure 6A:
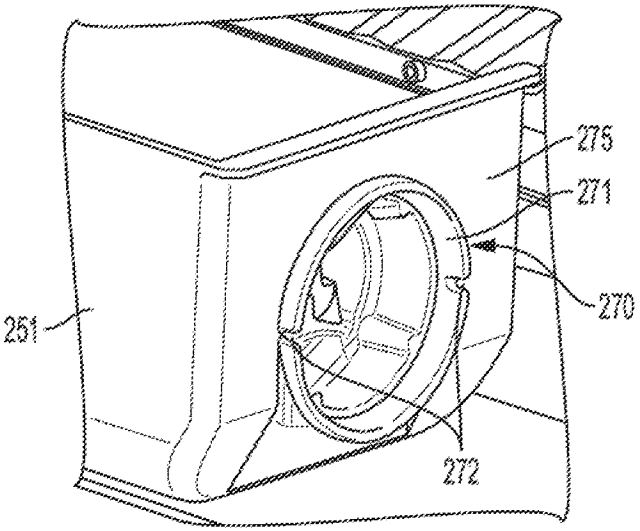
Figure 6B:
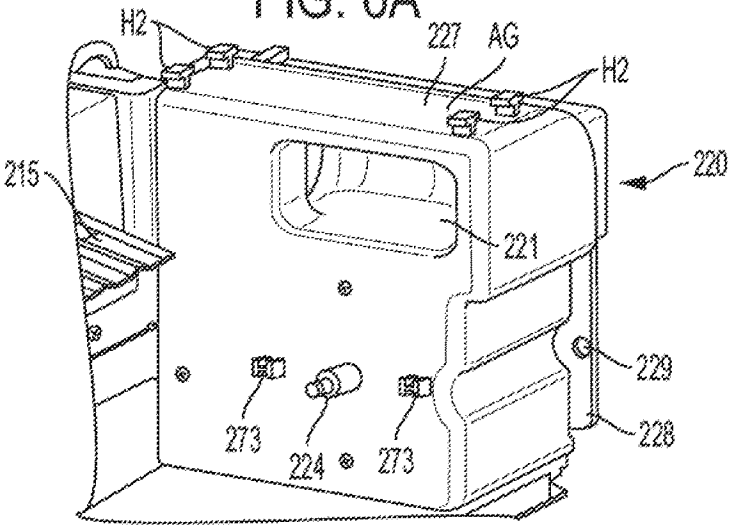

As best shown in FIGS. 6A-6D, an anti-rotation member 270 is disposed on a rear exterior wall 275 of the ice bucket 251 and is configured to engage with a complementary member disposed at a rear portion of the ice compartment according to an exemplary embodiment consistent with present disclosure. More specifically, the anti-rotation member 270 comprises an annular rim 271 having a pair of notches or recesses 272 spaced, for example, 180 degrees apart (see FIG. 6A). The notches 272 are configured to engage with complementary projections 273 on condition that the ice bucket 251 is fully inserted into the ice compartment housing assembly 230. Each of the projections 273 may be H-shaped so that the cross bar of the H engages the corresponding notch 272 (see FIGS. 6B, 6C, and 6D). As shown in FIG. 6B, the H-shaped projections 273 may be formed on the air handler/auger motor assembly 220.

FIGS. 7A and 7B are various views of the housing collar 236 and ice bucket 251 with front cover C according to an exemplary embodiment consistent with present disclosure. FIG. 7A shows a retention rib 280 projecting upward from the lower surface of the housing collar 236 and into the opening 236' and configured to engage with the front end portions 285' of a plurality of ribs or rails 285 formed on the bottom surface of the ice bucket 251 to retain the ice bucket 251 within the ice compartment 200 on condition that the ice bucket 251 is fully inserted into the ice compartment. The ribs 285 also facilitate the sliding action of the ice bucket 251 when it is removed by a user or returned back into position within the ice compartment housing assembly 230. The bottom of the front cover C also includes a gripper recess G for the user to insert their fingers to pull and remove the ice bucket 251 or return the same into position. The user would simply lift and pull back the front cover C using the gripper recess G to slide the ribs 285 of the ice bucket 251 up and over the retention rib 280.

FIG. 8 is a fragmentary front elevational view showing an L-shaped ice compartment 300 with the ice bucket with front cover and the housing collar all removed for ease of understanding according to an exemplary embodiment consistent with present disclosure. The L-shaped ice compartment 300 has the same layer construction as the U-shaped ice compartment assembly 230. However, the L-shaped ice compartment 300 cooperates with the inner top wall 103A', the inner back wall 103A", and the inner side wall 103A'" of the fresh food compartment 103A of the refrigerator 100A to form the insulated ice compartment. A gasket (not shown) may be included between the edges of the L-shaped wall and the inner walls of the fresh food compartment 103A. A bracket B' which is part of the refrigerator structure and which has a connection WF for a water fill tube, and a front wall of an alternative air handler/auger motor assembly 220A are also visible in FIG. 8.

FIGS. 9A and 9B are front cross-sectional views of a modified L-shaped ice compartment 400 with the ice bucket with front cover and the housing collar removed for ease of understanding according to an exemplary embodiment consistent with present disclosure. FIGS. 10A and 10B are perspective views of the modified L-shaped ice compartment assembly without and with the housing collar, respectively, according to an exemplary embodiment consistent with present disclosure. In particular, the modified L-shaped ice compartment 400 is positioned in the upper left corner of a refrigerator compartment 1003. The refrigerator compartment is positioned over a freezer compartment 1002 of a French door-bottom mount style refrigerator 1000. The modified L-shaped ice compartment 400 includes an insulated L-shaped wall 430 that has the same layer construction as the U-shaped ice compartment assembly 230. The L-shaped, insulated wall 430 includes a vertical projection 434 on an end of a horizontal portion of the L-shaped wall 430, the vertical projection 434 being configured to engage with a stepped portion 437 of the inner side wall 1003'" of the fresh food compartment 1003. The L-shaped wall 430 cooperates with the inner top wall 1003', the inner back wall 1003", and the inner side wall 1003'" of the fresh food compartment 1003 to form the insulated ice compartment. A gasket 435 may be included between the edges of the L-shaped wall 430 and the inner walls of the fresh food compartment 1003. A further gasket 435' may be included between the smaller vertical projection 434 and the stepped portion 437. Moreover, a housing collar 436 is disposed on an open front portion of the L-shaped wall 430, with the housing collar 436 having an opening 436' therein for receiving the ice bucket 251. The stepped portion 437 may be formed by making the inner side wall 1003'" of the fresh food compartment 1003 thicker at a region 1003A corresponding to an interior of the L-shaped wall 430 as compared to a region 1003B of the inner side wall 1003'" of the fresh food compartment 1003 where the vertical projection 434 engages and therebelow.

FIGS. 11A and 11B show perspective and elevational views, respectively, of a rear portion 290 of the front cover C and ice bucket 251 without a gasket according to an exemplary embodiment consistent with present disclosure. By having no gasket between the rear portion of the front cover C, when the ice bucket 251 is in the fully inserted position, the rear portion of the front cover C engages the housing collar 236 but still allows some movement of air between the ice compartment 200 and the fresh food compartment 103. The hollow inside of the front cover C includes insulation, and the insulation may entirely fill the inside of the front cover C. Alternatively, the lower region around the ice bucket outlet opening 252 may be free of any insulation.

FIGS. 12A and 12B show perspective and elevational views, respectively, of a rear portion of the front cover and ice bucket with a closed gasket according to an exemplary embodiment consistent with present disclosure. This configuration is the same as that of FIGS. 11A and 11B except that a gasket 295 surrounds the entire outer edge portion of the rear portion 290 of the front cover C to form a closed gasket 295. By having a closed gasket 295 between the rear portion of the front cover C, when the ice bucket 251 is in the fully inserted position, the rear portion of the front cover C engages the housing collar 236 so that the gasket 295 seals the ice compartment 200 from the fresh food compartment 103 to prevent the movement of any air between the two compartments.

FIGS. 13A and 13B show perspective and elevational views, respectively, of a rear portion 290 of the front cover C and ice bucket 251 with an open gasket with a labyrinth 296 according to an exemplary embodiment consistent with present disclosure. This configuration is the same as that of FIGS. 11A and 11B except that an open gasket with a labyrinth 296 that includes at least one opening 296' is used, such that when the ice bucket 251 is in the fully inserted position, the rear portion of the front cover C engages the housing collar 236 via the open gasket with a labyrinth 296 but still allows some movement of air between the ice compartment 200 and the fresh food compartment 103 via the opening 296'.

FIGS. 14A and 14B show perspective and elevational views, respectively, of a rear portion 290 of the front cover C and ice bucket 251 with variants of an open gasket with a labyrinth according to an exemplary embodiment consistent with present disclosure. In particular, the variant of FIG. 14A has an open gasket with a labyrinth 297 that includes at least one opening 297' at the bottom end of a portion that extends down along one side of the rear portion 290 of the front cover C. The variant of FIG. 14B has an open gasket with a labyrinth 298 that includes at least one opening 298' at the bottom end of a portion that extends down along one side of the rear portion 290 of the front cover C, but also includes a horizontal extension 299 that extends beyond the opening 298' along a lower edge portion of the rear portion 290 of the front cover C.

Figure 15B:
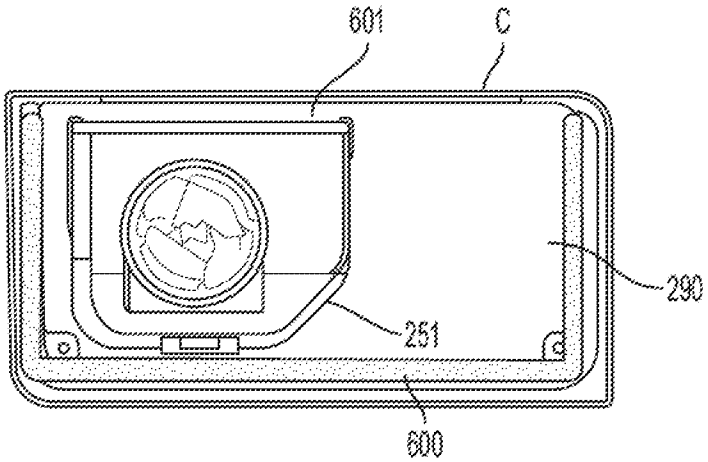
Figure 16B:
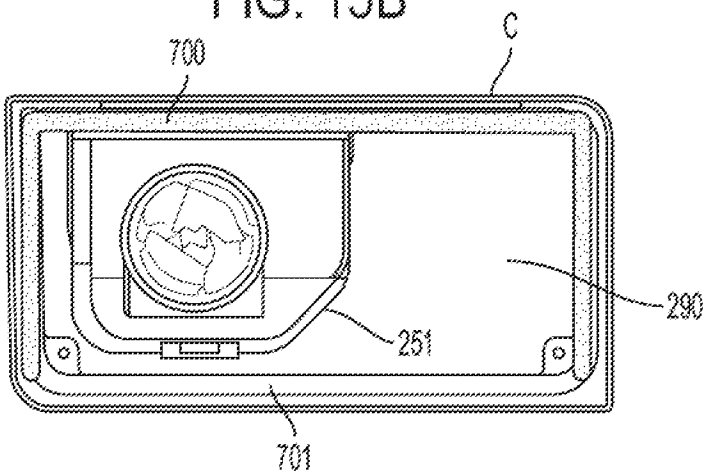
Figure 15A:
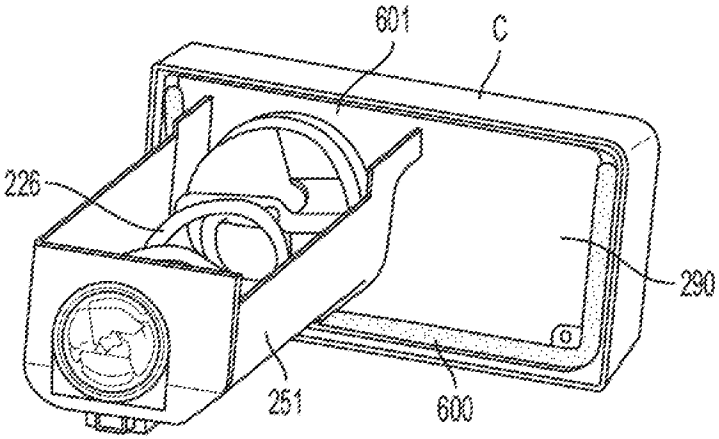
Figure 16A:
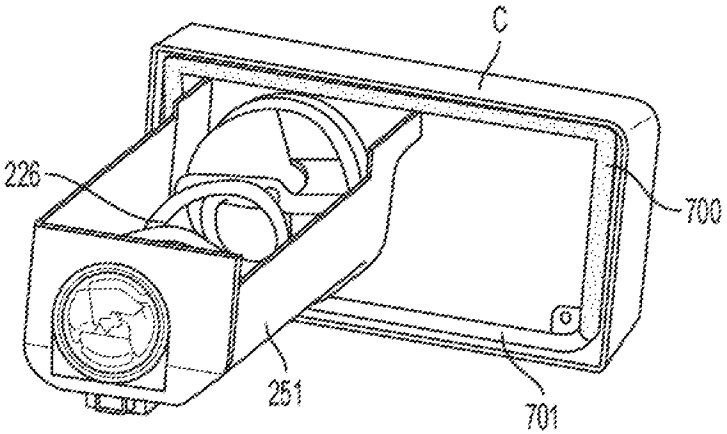

FIGS. 15A and 15B, 16A and 16B, 17A and 17B, and 18A and 18B show perspective and elevational views, respectively, of a rear portion of the front cover and ice bucket with variants of an open gasket with a generally U-shape facing up, down, right, and left, respectively, according to four exemplary embodiments consistent with present disclosure. In particular, FIGS. 15A and 15B show the generally U-shaped gasket 600 with the opening 601 at the top, FIGS. 16A and 16B show the generally U-shaped gasket 700 with the opening 701 at the bottom, FIGS. 17A and 17B show the generally U-shaped gasket 800 with the opening 801 at the right side, and FIGS. 18A and 18B show the generally U-shaped gasket 900 with the opening 901 at the left side.

In operation and during the ice making mode, the refrigerant valve 511 (see FIG. 19) directs the refrigerant gas through the evaporator tube 213 which directly contacts the ice tray by virtue of being die cast over-molded inside the ice maker tray/evaporator 212. A water fill valve (not shown) that is located in the water fill tube that connects to the connection WF is opened in order to fill the cavities 212' with water and then is closed after a predetermined period of time (e.g., 5 seconds) has elapsed. Once the water in the individual cavities 212' is frozen, which is determined by the thermistor T that continuously senses the ice maker tray/evaporator 212 up to a predefined temperature, the refrigerant valve 511 bypasses or diverts the refrigerant gas to, for example, the freezer evaporator 504 and then the defrost heater DH is turned "ON". Once a predetermined temperature is reached, the defrost heater DH is turned "OFF" and the ejector fingers 216 are rotated by the shaft 216' to scoop out the ice pieces (for example, ice cubes) from the tray cavities 212'. After a complete turn of 360 degrees of the ejector fingers, the cycle is restarted with water by the water fill valve (see connection WF for a water fill tube) filling the cavities 212' and the refrigerant valve 511 redirecting the refrigerant to the ice maker tray/evaporator 212.

The present invention has substantial opportunity for variation without departing from the spirit or scope of the present invention. For example, while FIG. 1 shows a French door-bottom mount (FDBM) style refrigerator, the present invention can be utilized in FDBM configurations having one or more intermediate compartments (such as, but not limited to, pullout drawers) that can be operated as either fresh food compartments or freezer compartments and which are located between the main fresh food compartment and the main freezer compartment, a side-by-side refrigerator where the refrigerator compartment and the freezer compartment are disposed side-by-side in a vertical orientation, as well as in other well-known refrigerator configurations, such as but not limited to, top freezer configurations, bottom freezer configurations, and the like. Also, while the slimline ice compartment is shown in the fresh food compartment, the slimline ice compartment could be disposed in a freezer compartment.

Those skilled in the art will recognize improvements and modifications to the exemplary embodiments of the present invention. All such improvements and modifications are considered within the scope of the concepts disclosed herein and the claims that follow.

What is claimed is:

1. A refrigerator comprising:
a fresh food compartment;
a freezer compartment;
an ice compartment disposed in at least one of the fresh food compartment or the freezer compartment;
an ice maker disposed in the ice compartment; and
an ice bucket for storing ice, the ice bucket being disposed in the ice compartment,
wherein the ice maker and the ice bucket are arranged side-by-side in a horizontal direction within the ice compartment, and
wherein no portion of the ice bucket is located below the ice maker when the ice maker is projected downward in a vertical height direction.

2. The refrigerator of claim 1, wherein the ice compartment is disposed in the fresh food compartment.

3. The refrigerator of claim 1, wherein the ice compartment is disposed in an upper corner of the fresh food compartment.

4. The refrigerator of claim 1, wherein the refrigerator is a French door-bottom mount configuration having the fresh food compartment on top and the freezer compartment below the fresh food compartment.

5. The refrigerator of claim 4, wherein the ice compartment is disposed in an upper left hand corner of the fresh food compartment.

6. The refrigerator of claim 1, wherein the ice bucket is removably mounted in the ice compartment.

7. The refrigerator of claim 1, wherein the ice compartment has a thin dimension in a vertical height direction H of approximately 5.6 inches±2.0 inches.

8. The refrigerator of claim 7, wherein the ice compartment has a horizontal width W of approximately 10.4 inches±2.0 inches.

9. The refrigerator of claim 6, wherein the ice bucket has a front cover, and the front cover has an opening in a bottom portion for discharging pieces of ice.

10. The refrigerator of claim 9, wherein the fresh food compartment includes a door, and further comprising an ice chute for an ice dispenser and being disposed in the door, the ice chute being configured to communicate with the opening in the front cover via an ice chute extension.

11. The refrigerator of claim 9, wherein the front cover has an open gasket with a labyrinth disposed between the front cover and the ice compartment.

12. The refrigerator of claim 6, wherein the ice bucket includes a plurality of ribs on a bottom surface thereof.

13. The refrigerator of claim 1, wherein the ice compartment is formed by a U-shaped, insulated housing that cooperates with an inner top wall and an inner back wall of the fresh food compartment.

14. The refrigerator of claim 13, wherein a gasket is disposed between an edge of the U-shaped, insulated housing and the inner top wall and the inner back wall of the fresh food compartment.

15. The refrigerator of claim 13, wherein a housing collar is disposed on an open front portion of the U-shaped, insulated housing, the housing collar having an opening therein for receiving the ice bucket.

16. The refrigerator of claim 15, wherein the housing collar includes at least one retention rib that projects into the opening and is configured to engage with the ice bucket to retain the ice bucket within the ice compartment on condition that the ice bucket is fully inserted into the ice compartment.

17. The refrigerator of claim 13, wherein the U-shaped, insulated housing includes locating extensions extending from a lower rear portion of the edge, the locating extensions being configured to fit into a bracket positioned in the inner back wall of the fresh food compartment.

18. The refrigerator of claim 17, wherein a housing collar is disposed on an open front portion of the U-shaped, insulated housing, the housing collar having an opening therein for receiving the ice bucket, and further having a plurality of fastener holes configured to receive fasteners for fastening the U-shaped, insulated housing to the inner top wall of the fresh food compartment.

19. The refrigerator of claim 1, wherein the ice compartment is formed by an L-shaped, insulated housing that cooperates with an inner side wall, an inner top wall, and an inner back wall of the fresh food compartment.

20. The refrigerator of claim 19, wherein a gasket is disposed between an edge of the L-shaped insulated housing and the inner top wall, the inner side wall, and the inner back wall of the fresh food compartment.

21. The refrigerator of claim 19, wherein the L-shaped, insulated housing includes a vertical projection on an end of a horizontal portion of the L-shape, the vertical projection being configured to engage with a stepped portion of the inner side wall of the fresh food compartment.

22. The refrigerator of claim 21, wherein a gasket is disposed between an edge of the L-shaped insulated housing and the inner top wall, the stepped portion of inner side wall, and the inner back wall of the fresh food compartment.

23. The refrigerator of claim 6, wherein the ice bucket includes an anti-rotation member disposed on a rear exterior wall thereof and which is configured to engage with a complementary member disposed at a rear portion of the ice compartment.

24. The refrigerator of claim 23, wherein the anti-rotation member comprises an annular rim projecting from the rear exterior wall of the ice bucket and having a pair of recesses configured to engage with corresponding H-shaped projections as the complementary member formed on an air handler/auger motor assembly.

25. The refrigerator of claim 12, wherein a housing collar is disposed on an open front portion of the ice compartment, the housing collar having an opening therein for receiving the ice bucket, and wherein the housing collar includes at least one retention rib that projects into the opening and is configured to engage with front end portions of the plurality of ribs on the bottom surface of the ice bucket to retain the ice bucket within the ice compartment on condition that the ice bucket is fully inserted into the ice compartment.

26. The refrigerator of claim 9, wherein the front cover has an open gasket with a generally U-shape having an open portion facing one of up, down, left, or right disposed between the front cover and the ice compartment.

27. A refrigerator comprising:
a refrigerator compartment;
a freezer compartment;
an ice compartment disposed in the refrigerator compartment;
an ice maker disposed in the ice compartment; and
an ice bucket for storing ice, the ice bucket being disposed in the ice compartment,
wherein the ice bucket is removably mounted in the ice compartment,
wherein the ice bucket has a front cover, and
wherein the front cover has an open gasket disposed between the front cover and the ice compartment, such that at least an amount of air exchange is permitted to occur between the refrigerator compartment and the ice compartment.

28. The refrigerator of claim 27, wherein the open gasket comprises a labyrinth.

29. The refrigerator of claim 27, wherein the open gasket comprises a generally U-shape having an open portion facing one of up, down, left, or right disposed between the front cover and the ice compartment.

30. The refrigerator of claim 27, wherein the front cover has an opening in a bottom portion for discharging pieces of ice.

31. A refrigerator comprising:
a refrigerator compartment;
a freezer compartment;
an ice compartment disposed in the refrigerator compartment;
an ice maker disposed in the ice compartment; and
an ice bucket for storing ice, the ice bucket being disposed in the ice compartment,
wherein the ice compartment is formed by an L-shaped, insulated housing that cooperates with an inner side wall, an inner top wall, and an inner back wall of the refrigerator compartment,
wherein the L-shaped, insulated housing includes a vertical projection on an end of a horizontal portion of the L-shape, the vertical projection being configured to engage with a stepped portion of the inner side wall of the refrigerator compartment,
wherein the vertical projection comprises a wall portion that projects upward from the horizontal portion of the L-shape, the wall portion extending from front to back of the ice compartment, and
wherein the stepped portion is formed by making the inner side wall of the refrigerator compartment thicker at a region corresponding to an interior of the L-shaped, insulated housing as compared to a region of the inner side wall of the refrigerator compartment where the vertical projection engages and therebelow, such that an upper edge of the wall portion of the vertical projection abuts against a lower surface of the stepped portion of the inner side wall of the refrigerator compartment.

32. A refrigerator comprising:
a fresh food compartment;

a freezer compartment, the refrigerator being a French door-bottom mount configuration having the fresh food compartment on top and the freezer compartment below the fresh food compartment;

an ice compartment disposed in an upper corner of the fresh food compartment;

an ice maker disposed in the ice compartment; and an ice bucket for storing ice, the ice bucket being disposed in the ice compartment, wherein the ice maker and the ice bucket are arranged side-by-side in a horizontal direction within the ice compartment, such that no portion of the ice bucket is located below the ice maker when the ice maker is projected downward in a vertical height direction.

* * * * *